US011398173B2

(12) United States Patent
Han

(10) Patent No.: US 11,398,173 B2
(45) Date of Patent: Jul. 26, 2022

(54) DISPLAY DEVICE

(71) Applicant: SAMSUNG DISPLAY CO., LTD., Yongin-si (KR)

(72) Inventor: Sang Myeon Han, Hwaseong-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 17/343,545

(22) Filed: Jun. 9, 2021

(65) Prior Publication Data

US 2022/0068176 A1 Mar. 3, 2022

(30) Foreign Application Priority Data

Aug. 27, 2020 (KR) ..... 10-2020-0108253

(51) Int. Cl.
*G09G 3/00* (2006.01)
*G09G 3/32* (2016.01)

(52) U.S. Cl.
CPC ..... *G09G 3/006* (2013.01); *G09G 3/32* (2013.01); *G09G 2320/045* (2013.01)

(58) Field of Classification Search
CPC ..... G09G 2320/045; G09G 3/32; G09G 3/006
See application file for complete search history.

(56) References Cited

U.S. PATENT DOCUMENTS

| | | | | |
|---|---|---|---|---|
| 8,922,595 | B2 | 12/2014 | Ahn et al. | |
| 9,715,848 | B2 | 7/2017 | Kim et al. | |
| 10,262,582 | B2 | 4/2019 | Han | |
| 10,839,743 | B2 | 11/2020 | Han | |
| 2013/0002960 | A1* | 1/2013 | Ryu | G09G 3/3225 348/E5.077 |
| 2014/0118426 | A1 | 5/2014 | Chun et al. | |
| 2014/0176617 | A1* | 6/2014 | Jeong | G09G 3/2003 345/55 |
| 2016/0098952 | A1* | 4/2016 | Han | G09G 3/3225 345/76 |
| 2016/0140901 | A1* | 5/2016 | Bae | G09G 3/3233 345/212 |
| 2021/0049960 | A1 | 2/2021 | Han | |

FOREIGN PATENT DOCUMENTS

| | | | |
|---|---|---|---|
| JP | 2015-219307 | A | 12/2015 |
| KR | 10-2017-0088452 | A | 8/2017 |
| KR | 10-1871195 | B1 | 6/2018 |
| KR | 10-1975215 | B1 | 8/2019 |
| KR | 2020-0021012 | A | 2/2020 |

OTHER PUBLICATIONS

PCT International Search Report and Written Opinion dated Dec. 3, 2021, issued in corresponding Application No. PCT/KR2021/011425, 8 pages.

* cited by examiner

*Primary Examiner* — Muhammad N Edun
(74) *Attorney, Agent, or Firm* — Lewis Roca Rothgerber Christie LLP

(57) ABSTRACT

Provided is a display device. The display device includes pixels including light emitting elements, a weight calculation unit configured to calculate a weight of one of the pixels based on an amount of current flowing therethrough and a number of light emitting elements thereof, a deterioration accumulation unit configured to accumulate a deterioration amount of the one of the pixels based on the weight and previous compensation data thereof, and a data compensation unit configured to generate compensation data to be supplied to the one of the pixels based on the deterioration amount thereof.

20 Claims, 18 Drawing Sheets

EL: EL1, EL2, ... , ELk

DISPLAY DEVICE

CROSS-REFERENCE TO RELATED APPLICATION

This application claims priority to, and the benefit of, Korean Patent Application No. 10-2020-0108253 filed on Aug. 27, 2020, in the Korean Intellectual Property Office, and all the benefits accruing therefrom, the contents of which in its entirety are herein incorporated by reference.

BACKGROUND

1. Field

The present disclosure relates to a display device.

2. Description of the Related Art

A display device may include a plurality of light emitting elements. The plurality of light emitting elements may have a property that causes them to deteriorate as they are used and as they emit heat. The display device may measure a deterioration amount of each of a plurality of pixels, and may generate compensation data for the plurality of pixels. In this case, if it is not possible to accurately measure the deterioration amount of each of the pixels, an afterimage compensation error may occur, and the plurality of pixels may not be appropriately compensated.

SUMMARY

Aspects of the present disclosure provide a display device capable of improving performance of afterimage compensation by more accurately calculating the deterioration amount of each of a plurality of pixels.

However, aspects of the present disclosure are not restricted to the one set forth herein. The above and other aspects of the present disclosure will become more apparent to one of ordinary skill in the art to which the present disclosure pertains by referencing the detailed description of the present disclosure given below.

According to some embodiments of the present disclosure, a display device includes pixels including light emitting elements, a weight calculation unit configured to calculate a weight of one of the pixels based on an amount of current flowing therethrough and a number of light emitting elements thereof, a deterioration accumulation unit configured to accumulate a deterioration amount of the one of the pixels based on the weight and previous compensation data thereof, and a data compensation unit configured to generate compensation data to be supplied to the one of the pixels based on the deterioration amount thereof.

At least some of the pixels may have different numbers of light emitting elements.

The weight calculated by the weight calculation unit may become higher as the amount of current flowing is larger, or as the number of light emitting elements is smaller.

The deterioration accumulation unit may be configured to accumulate a current deterioration amount of the one of the pixels by accumulating a product of a current frame age and the weight to a previous deterioration amount of the pixel.

The deterioration amount calculated by the deterioration accumulation unit may increase as the weight becomes higher or as the previous compensation data becomes greater.

The data compensation unit may be configured to generate the compensation data by applying the deterioration amount to a preset look-up table.

The weight calculation unit may be configured to calculate a weight of a pixel group including some of the pixels based on an amount of current flowing through the pixel group and a number of light emitting elements in the pixel group.

The display device may further include a display area including the pixels, and a non-display area surrounding the display area, wherein the pixel group corresponds to a corresponding point in the display area.

The weight calculation unit may be configured to calculate a weight of a pixel block including pixel groups, each pixel group having some of the pixels, based on an amount of current flowing through the pixel group and the number of light emitting elements in the pixel group.

The pixels may further include a pixel circuit connected to a data line, a gate line, and a driving voltage line, wherein the light emitting elements are connected between an output node of the pixel circuit and a low potential line.

The deterioration accumulation unit may include an age calculation module configured to calculate an age of the one of the pixels based on previous compensation data thereof, and a deterioration accumulation module configured to accumulate a deterioration amount of the one of the pixels based on the weight and the age thereof.

The weight calculation unit may be configured to calculate a weight of a pixel group having some of the pixels based on an amount of current flowing through the pixel group, and the number of light emitting elements in the pixel group.

The deterioration accumulation module may be configured to accumulate a deterioration amount of the pixel group by applying a weight of the pixel group to an age of the pixel group.

The weight calculation unit may be configured to calculate a weight of a pixel block including pixel groups, each pixel group having some of the pixels, based on an amount of current flowing through the pixel group, and the number of light emitting elements in the pixel group.

The deterioration accumulation module may be configured to accumulate a deterioration amount of the pixel block by applying the weight of the pixel block to an age of the pixel block.

The deterioration accumulation unit may include an age calculation module configured to calculate an age of the one of the pixels based on previous compensation data thereof and based on a first weight that is a part of the weight, and a deterioration accumulation module configured to accumulate a deterioration amount of the one of the pixels based on a second weight that is another part of the weight and based on the age of the one of the pixels.

The weight calculation unit may be configured to calculate a first weight and a second weight of a pixel group including some of the pixels based on an amount of current flowing through the pixel group and based on the number of light emitting elements in the pixel group.

The age calculation module may be configured to calculate an age of the pixel group based on the first weight of the pixel group and based on previous compensation data of the pixel group, wherein the deterioration accumulation module is configured to accumulate a deterioration amount of the pixel group by applying the second weight of the pixel group to the age of the pixel group.

The weight calculation unit may be configured to calculate a first weight and a second weight of a pixel block including pixel groups, each pixel group having some of the pixels, based on an amount of current flowing through the pixel group and based on the number of light emitting elements in the pixel group.

The age calculation module may be configured to calculate an age of the pixel block based on the first weight of the pixel block and based on previous compensation data of the pixel block, wherein the deterioration accumulation module is configured to accumulate a deterioration amount of the pixel block by applying the second weight of the pixel block to the age of the pixel block.

In accordance with the display device according to some of the embodiments, when at least some pixels have different numbers of light emitting elements, the display device calculates the weights and the deterioration amounts of the pixels based on the amount of current flowing through the pixels, and based on the number of the light emitting elements of the pixels. Accordingly, the deterioration amounts of the pixels can be calculated more accurately, and the afterimage compensation performance of the display device can be improved.

The aspects of the present disclosure are not limited to the aforementioned aspects, and various other aspects are included in the present specification.

BRIEF DESCRIPTION OF THE DRAWINGS

The above and other aspects of the present disclosure will become more apparent by describing in detail embodiments thereof with reference to the attached drawings, in which.

DETAILED DESCRIPTION

Figure 1:
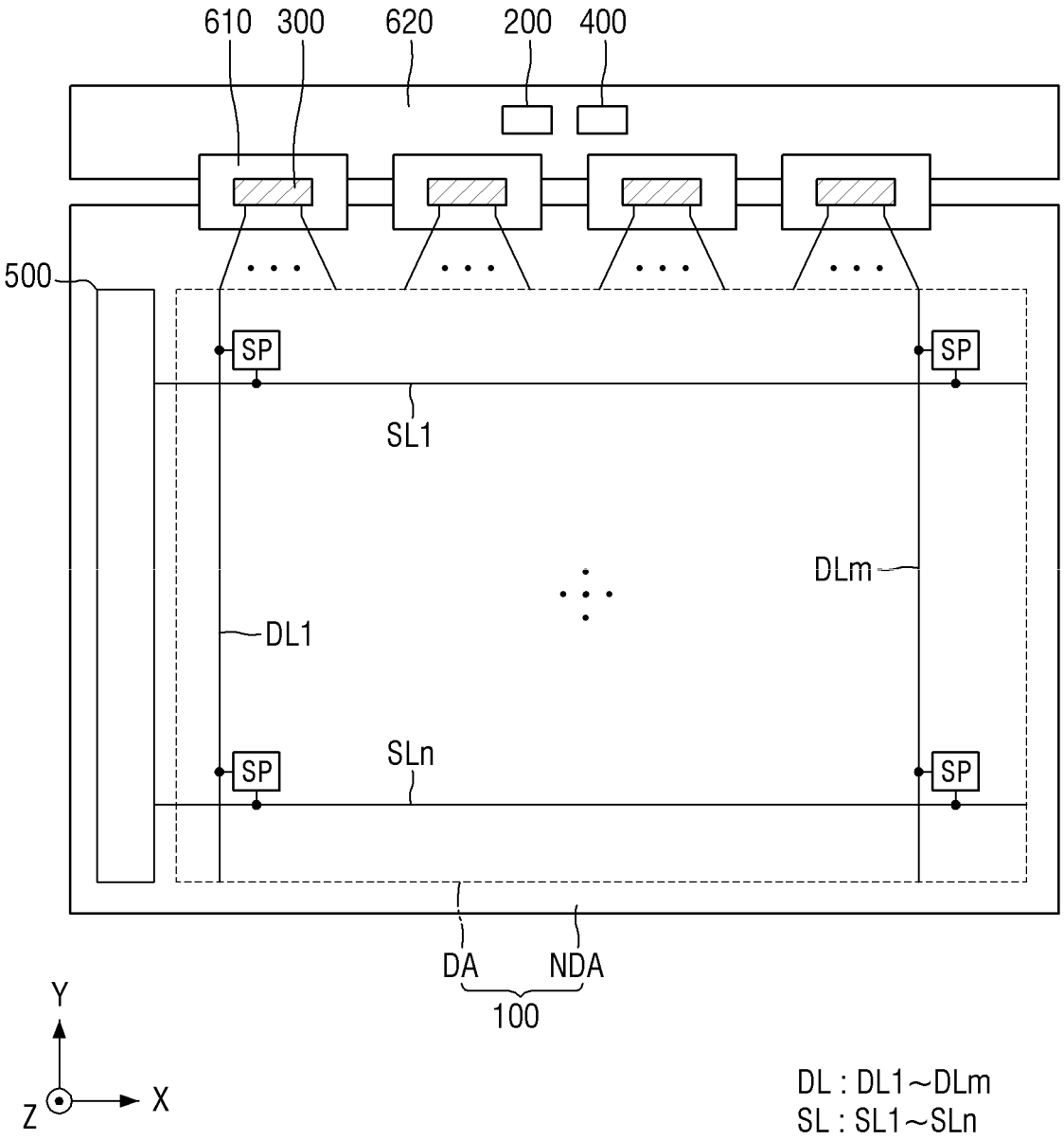
FIG. 1 is a plan view illustrating a display device according to some embodiments.

In the following description, for the purposes of explanation, numerous specific details are set forth in order to provide a thorough understanding of various embodiments or implementations of the invention. As used herein "embodiments" and "implementations" are interchangeable words that are non-limiting examples of devices or methods employing one or more of the inventive concepts disclosed herein. It is apparent, however, that various embodiments may be practiced without these specific details or with one or more equivalent arrangements. In other instances, well-known structures and devices are shown in block diagram form in order to avoid unnecessarily obscuring various embodiments. Further, various embodiments may be different, but do not have to be exclusive. For example, specific shapes, configurations, and characteristics of an embodiment may be used or implemented in other embodiments without departing from the inventive concepts.

Unless otherwise specified, the illustrated embodiments are to be understood as providing features of varying detail of some ways in which the inventive concepts may be implemented in practice. Therefore, unless otherwise specified, the features, components, modules, layers, films, panels, regions, and/or aspects, etc. (hereinafter individually or collectively referred to as "elements"), of the various embodiments may be otherwise combined, separated, interchanged, and/or rearranged without departing from the inventive concepts.

The use of cross-hatching and/or shading in the accompanying drawings is generally provided to clarify boundaries between adjacent elements. As such, neither the presence nor the absence of cross-hatching or shading conveys or indicates any preference or requirement for particular materials, material properties, dimensions, proportions, commonalities between illustrated elements, and/or any other characteristic, attribute, property, etc., of the elements, unless specified.

Further, in the accompanying drawings, the size and relative sizes of elements may be exaggerated for clarity and/or descriptive purposes. When an embodiment may be implemented differently, a specific process order may be performed differently from the described order. For example, two consecutively described processes may be performed substantially at the same time or performed in an order opposite to the described order. Also, like reference numerals denote like elements.

When an element, such as a layer, is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. To this end, the term "connected" may refer to physical, electrical, and/or fluid connection, with or without intervening elements.

Further, the X-axis, the Y-axis, and the Z-axis are not limited to three axes of a rectangular coordinate system, such as the x, y, and z axes, and may be interpreted in a broader sense. For example, the X-axis, the Y-axis, and the Z-axis may be perpendicular to one another, or may represent different directions that are not perpendicular to one another.

For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. As used herein, the term "and/or" includes any and all combinations of one or more of the associated listed items.

Although the terms "first," "second," etc. may be used herein to describe various types of elements, these elements should not be limited by these terms. These terms are used to distinguish one element from another element. Thus, a first element discussed below could be termed a second element without departing from the teachings of the disclosure.

Spatially relative terms, such as "beneath," "below," "under," "lower," "above," "upper," "over," "higher," "side" (e.g., as in "sidewall"), and the like, may be used herein for descriptive purposes, and, thereby, to describe one elements relationship to another element(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof. It is also noted that, as used herein, the terms "substantially," "about," and other similar terms, are used as terms of approximation and not as terms of degree, and, as such, are utilized to account for inherent deviations in measured, calculated, and/or provided values that would be recognized by one of ordinary skill in the art.

Various embodiments are described herein with reference to sectional and/or exploded illustrations that are schematic illustrations of idealized embodiments and/or intermediate structures. As such, variations from the shapes of the illustrations as a result, for example, of manufacturing techniques and/or tolerances, are to be expected. Thus, embodiments disclosed herein should not necessarily be construed as limited to the particular illustrated shapes of regions, but are to include deviations in shapes that result from, for instance, manufacturing. In this manner, regions illustrated in the drawings may be schematic in nature and the shapes of these regions may not reflect actual shapes of regions of a device and, as such, are not necessarily intended to be limiting.

As customary in the field, some embodiments are described and illustrated in the accompanying drawings in terms of functional blocks, units, and/or modules. Those skilled in the art will appreciate that these blocks, units, and/or modules are physically implemented by electronic (or optical) circuits, such as logic circuits, discrete components, microprocessors, hard-wired circuits, memory elements, wiring connections, and the like, which may be formed using semiconductor-based fabrication techniques or other manufacturing technologies. In the case of the blocks, units, and/or modules being implemented by microprocessors or other similar hardware, they may be programmed and controlled using software (e.g., microcode) to perform various functions discussed herein and may optionally be driven by firmware and/or software. It is also contemplated that each block, unit, and/or module may be implemented by dedicated hardware, or as a combination of dedicated hardware to perform some functions and a processor (e.g., one or more programmed microprocessors and associated circuitry) to perform other functions. Also, each block, unit, and/or module of some embodiments may be physically separated into two or more interacting and discrete blocks, units, and/or modules without departing from the scope of the inventive concepts. Further, the blocks, units, and/or modules of some embodiments may be physically combined into more complex blocks, units, and/or modules without departing from the scope of the inventive concepts.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and should not be interpreted in an idealized or overly formal sense, unless expressly so defined herein.

Figure 2:
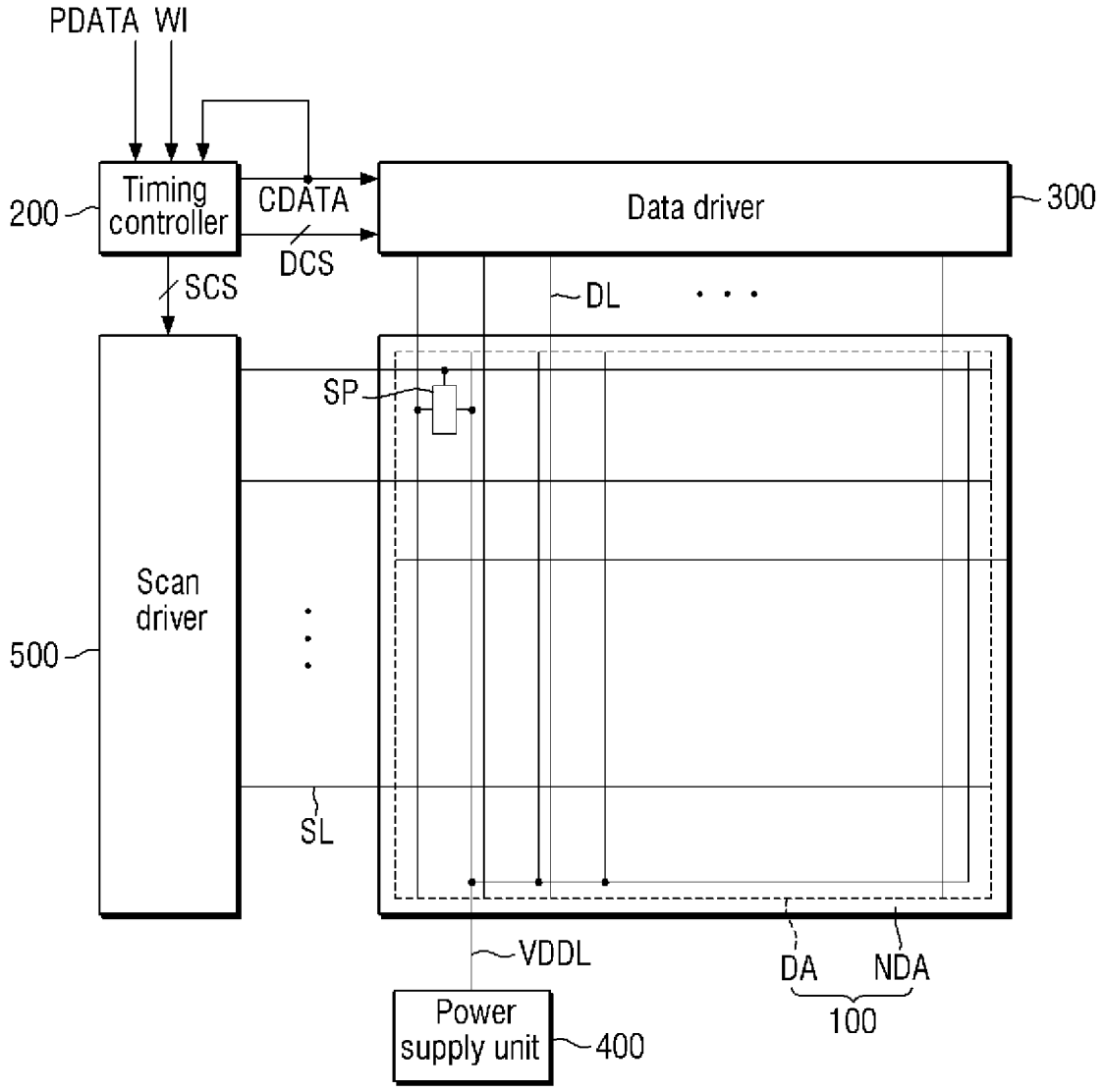
FIG. 2 is a block diagram illustrating a display device according to some embodiments.

FIG. 1 is a plan view illustrating a display device according to some embodiments. FIG. 2 is a block diagram illustrating a display device according to some embodiments.

Referring to FIGS. 1 and 2, a display device, as a device for displaying a moving or still image, may be employed as a display screen of various products such as a television, a laptop computer, a monitor, a billboard, and an Internet of Things (IoT) device, as well as portable electronic devices such as a mobile phone, a smartphone, a tablet personal computer (PC), a smart watch, a watch phone, a mobile communication terminal, an electronic notebook, an eBook reader, a portable multimedia player (PMP), a navigation device, and an ultra-mobile PC (UMPC).

The display device may include a display panel 100, a timing controller 200, a data driver 300, a power supply unit 400, and a scan driver 500.

The display panel 100 may have a rectangular shape in a plan view. For example, the display panel 100 may have a rectangular shape in a plan view, having long sides in a first direction (X-axis direction) and short sides in a second direction (Y-axis direction). A corner formed by the long side in the first direction (X-axis direction) and the short side in the second direction (Y-axis direction) may be rightangled or may be rounded (e.g., with a predetermined curvature). The planar shape of the display panel 100 is not limited to the rectangular shape, and may be formed in another polygonal shape, a circular shape, or an elliptical shape. For example, the display panel 100 may be formed to be flat, but is not limited thereto. In another example, the display panel 100 may be bent (e.g., with a predetermined curvature).

The display panel 100 may include a display area DA and a non-display area NDA.

The display area DA, which is an area for displaying an image, may be defined as the central area of the display panel 100. The display area DA may include a plurality of pixels SP formed in pixel areas defined by a plurality of data lines DL and a plurality of scan lines SL respectively crossing each other. Each of the plurality of pixels SP may be connected to at least one scan line SL, a data line DL, and a driving voltage line VDDL. Each of the plurality of pixels SP may be defined as an area of the smallest unit that outputs light.

A plurality of data lines DL may include first to $m^{th}$ data lines DL1 to DLm (m being a natural number of 2 or more). The first to $m^{th}$ data lines DL1 to DLm may extend in the second direction (Y-axis direction) while being spaced apart from each other in the first direction (X-axis direction). For example, each of the first to $m^{th}$ data lines DL1 to DLm may be connected to a plurality of pixels SP arranged along first to $m^{th}$ columns.

A plurality of scan lines SL may include first to nth scan lines SL1 to SLn (n being a natural number of 2 or more). The first to nth scan lines SL1 to SLn may extend in the first direction (X-axis direction) while being spaced apart from each other in the second direction (Y-axis direction). For example, each of the first to nth scan lines SL1 to SLn may be connected to a plurality of pixels SP arranged along first to nth rows.

The non-display area NDA may be defined as the remaining area of the display panel 100 that excludes the display area DA. For example, the non-display area NDA may include a scan driver 500 for applying scan signals to the scan lines SL, fan-out lines that connect the data lines DL to the data driver 300, and a pad portion connected to a ductile film 610.

The timing controller 200 may be mounted on a circuit board 620, and may receive pixel data PDATA and a timing synchronization signal supplied from a display driving system through a user connector located on the circuit board 620. The timing controller 200 may receive weight information WI supplied from a weight measurement system. Here, when the plurality of pixels SP represent the same luminance, the weight information WI may include the amount of current flowing through each of pixels SP, and the number of light emitting elements EL of each of pixels SP. Further, the weight information WI may further include the luminance of the plurality of pixels SP, the temperature depending on the positions of the plurality of pixels SP, and the light emission periods, and the light emission frequencies of the plurality of pixels SP, but is not limited thereto. The timing controller 200 may calculate the weight of each of pixels SP based on the weight information WI, and may accumulate the deterioration amount of each of pixels SP. The timing controller 200 may generate compensation data CDATA by applying the deterioration amount of each of pixels SP to the pixel data PDATA, and may provide the compensation data CDATA aligned to be suitable for the arrangement structure of the pixels SP to the data driver 300.

The timing controller 200 may generate a data control signal DCS and a scan control signal SCS based on the timing synchronization signal. The timing controller 200 may control the driving timing of the data driver 300 using the data control signal DCS, and control the driving timing of the scan driver 500 using the scan control signal SCS.

The data driver 300 may be located on the ductile film 610 and may be connected to the pad portion located in the non-display area NDA of the display panel 100. For example, the data driver 300 may be implemented as an integrated circuit IC. The data driver 300 may receive the compensation data CDATA and the data control signal DCS from the timing controller 200. The data driver 300 may generate a data voltage based on the compensation data CDATA, and may supply the data voltage to the data line DL based on the data control signal DCS. The data voltage may be supplied to the plurality of pixels SP through the data line DL to determine the luminance of the plurality of pixels SP.

The power supply unit 400 may be located on the circuit board 620 to supply a driving voltage to the data driver 300 and the display panel 100. The power supply unit 400 may generate the driving voltage, and may supply the driving voltage to the plurality of pixels SP arranged on the display panel 100 through the driving voltage line VDDL. The power supply unit 400 may generate a common voltage, and may supply the common voltage to a low potential line of the display panel 100. For example, the driving voltage may correspond to a high potential voltage capable of driving the plurality of pixels SP, and the common voltage may correspond to a low potential voltage commonly supplied to the plurality of pixels SP.

The scan driver 500 may be located in the non-display area NDA of the display panel 100. For example, the scan driver 500 may be located on one side of the non-display area NDA of the display panel 100, or may be located on the other side that is opposite to one side. In another example, the scan driver 500 may be located on both sides (e.g., right and left sides) of the non-display area NDA of the display panel 100. The scan driver 500 may generate scan signals based on the scan control signal SCS supplied from the timing controller 200, and may sequentially supply the scan signals to the plurality of scan lines SL (e.g., in a set order).

The ductile film 610 may mount thereon the data driver 300, and may connect the circuit board 620 to the pad portion of the display panel 100. The input terminals located on one side of the ductile film 610 may be attached to the circuit board 620 by a film adhesion process, and the output terminals located on the other side of the ductile film 610 may be attached to the pad portion of the display panel 100 by the film adhesion process. For example, the ductile film 610 may be a flexible film that can be bent, such as a tape carrier package or a chip on film. For example, the ductile film 610 may be bent toward the lower portion of the display panel 100 to reduce the bezel area of the display device, although the embodiments are not limited thereto.

The circuit board 620 may support the timing controller 200 and the power supply unit 400, and may supply various signals and power to the data driver 300. For example, the circuit board 620 may supply the signal supplied from the timing controller 200 and the driving voltage supplied from the power supply unit 400 to the data driver 300 and the scan driver 500, respectively, to display an image on each pixel. To this end, the signal transmission line and a plurality of power supply lines may be located on the circuit board 620.

Figure 3:
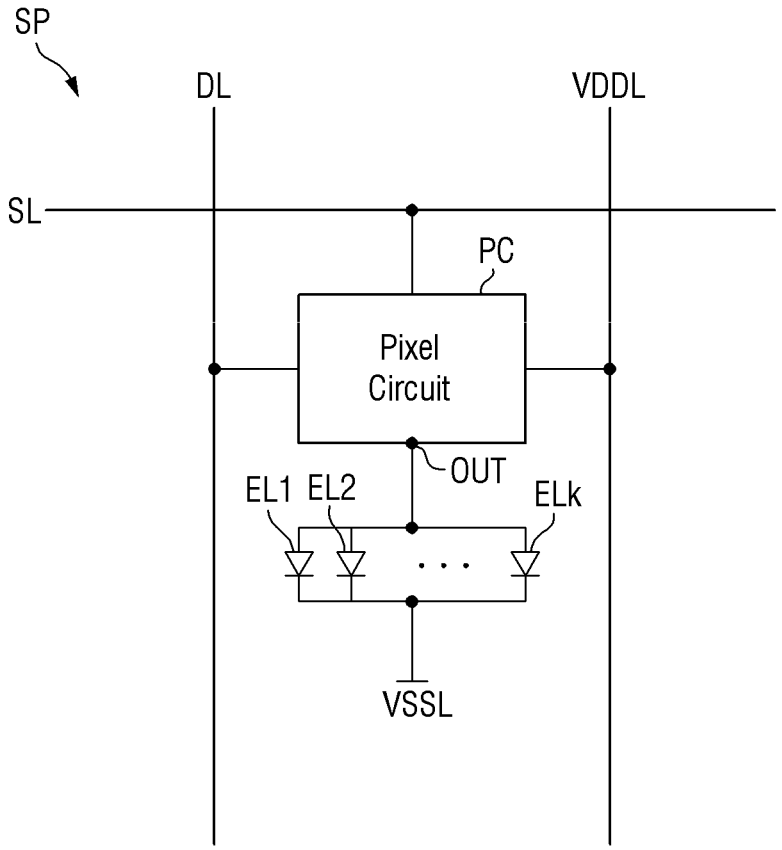
FIG. 3 is a diagram illustrating a pixel of a display device according to some embodiments.
Figure 4:
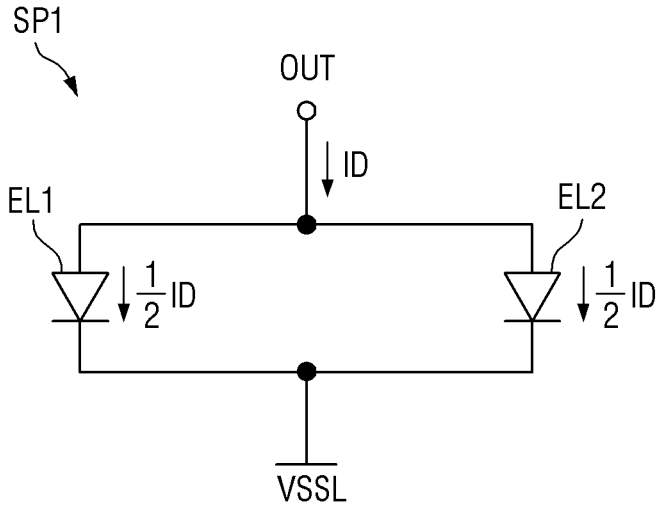
FIG. 4 is a diagram illustrating an example of a plurality of light emitting elements in the display device according to some embodiments.
Figure 5:
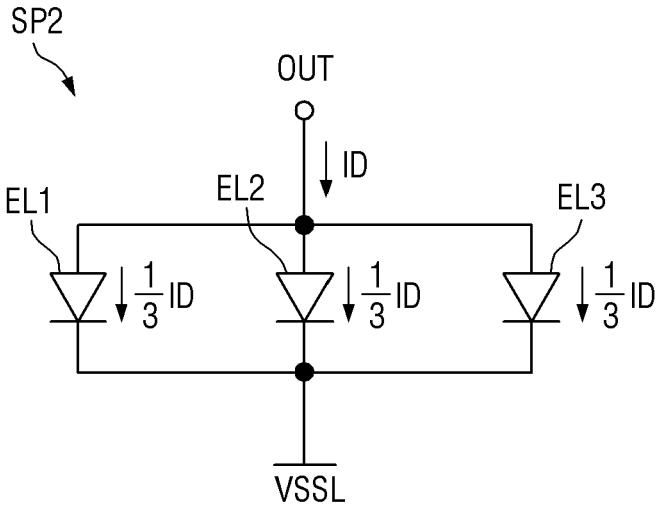
FIG. 5 is a diagram illustrating another example of a plurality of light emitting elements in the display device according to some embodiments.

FIG. 3 is a diagram illustrating a pixel of a display device according to some embodiments. FIG. 4 is a diagram illustrating an example of a plurality of light emitting elements in the display device according to some embodiments. FIG. 5 is a diagram illustrating another example of a plurality of light emitting elements in the display device according to some embodiments.

Referring to FIGS. 3 to 5, each of pixels SP may include a pixel circuit PC and a plurality of light emitting elements EL. The pixel circuit PC may be connected to a data line DL, at least one scan line SL, and a driving voltage line VDDL. The pixel circuit PC may include at least one switching element. At least one switching element of the pixel circuit PC may include a driving transistor. The driving transistor may control a driving current ID or a source-drain current based on a data voltage applied to a gate electrode. The driving current ID may flow through the channel of the driving transistor, and may be outputted through the output node OUT of the pixel circuit PC. The driving current ID may be supplied to the first electrodes of the plurality of light emitting elements EL, and may be distributed to the plurality of light emitting elements EL.

The plurality of light emitting elements EL may be connected between the output node OUT of the pixel circuit PC and a low potential line VSSL. For example, the light emitting element EL may be an inorganic light emitting diode including an inorganic material, but is not limited thereto. The light emitting elements EL may have a micrometer size or a nano-meter size. The plurality of light emitting elements EL may be aligned between two electrodes facing each other by an electric field formed in a corresponding direction between the two electrodes.

At least some of the plurality of pixels SP may have different numbers of light emitting elements EL. In a process of aligning the plurality of light emitting elements EL by the electric field formed between the two electrodes, at least some of the pixels SP may have different numbers of normally aligned light emitting elements EL. The plurality of normally aligned light emitting elements EL may receive the driving current ID and may emit light. Each of the plurality of pixels SP may include first to $k^{th}$ light emitting elements EL1 to Elk (k being a natural number of 2 or more). For example, the plurality of pixels SP may include a first pixel SP1 and a second pixel SP2.

In FIG. 4, the first pixel SP1 may include a first light emitting element EL1 and a second light emitting element EL2. The driving current ID outputted from the output node OUT of the pixel circuit PC may be supplied to the first electrodes of the plurality of light emitting elements EL, and may be distributed to and flow through the first light emitting element EL1 and the second light emitting element EL2. Therefore, each of the first light emitting element EL1 and the second light emitting element EL2 may emit light by ½ of the driving current ID.

In FIG. 5, the second pixel SP2 may include first to third light emitting elements EL1, EL2, and EL3. The driving current ID outputted from the output node OUT of the pixel circuit PC may be supplied to the first electrodes of the plurality of light emitting elements EL, and may be distributed to and flow through the first to third light emitting elements EL1, EL2, and EL3. Therefore, each of the first to third light emitting elements EL1, EL2, and EL3 may emit light by ⅓ of the driving current ID.

The light emitting element EL may deteriorate as it emits light by the driving current ID. The deterioration amount of the light emitting element EL may be determined by the magnitude of the driving current ID flowing through the light emitting element EL, the light emission time, or the age of the light emitting element EL. For example, the deterioration amount of the light emitting element EL may be increased as the magnitude of the driving current ID flowing through the light emitting element EL increases, as the light emission time of the light emitting element EL increases, and/or as the age of the light emitting element EL increases. Because the first pixel SP1 and the second pixel SP2 have different numbers of light emitting elements EL, the magnitude of the current flowing through one light emitting element EL, the light emission time, and/or the age of the light emitting element EL may be different. Therefore, the deterioration amounts of the plurality of light emitting elements EL of each of the first and the second pixel SP1 and SP2 may be different.

Figure 6:
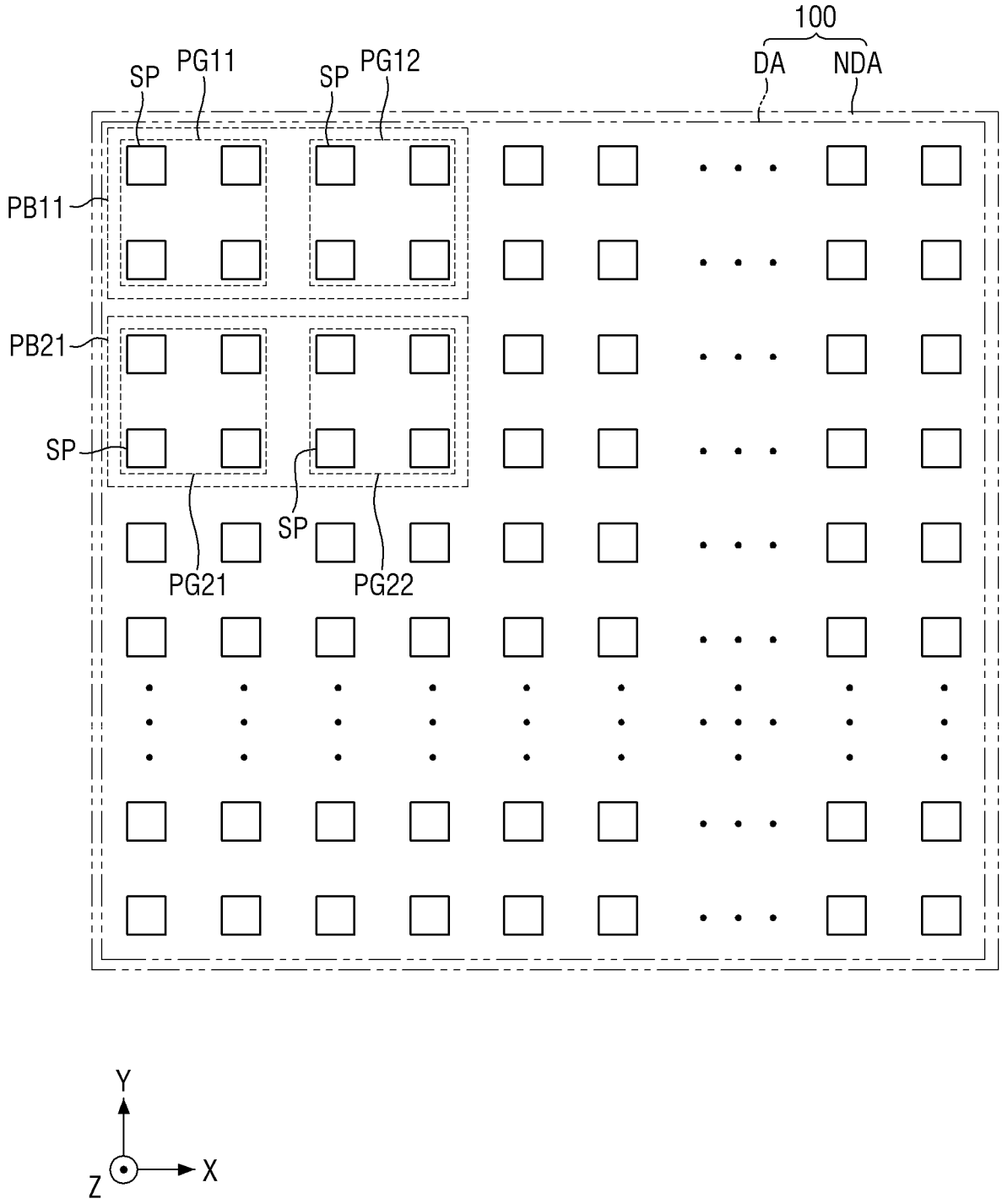
FIG. 6 is a plan view illustrating a pixel group and a pixel block in a display device according to some embodiments.

FIG. 6 is a plan view illustrating a pixel group and a pixel block in a display device according to some embodiments.

Referring to FIG. 6, the display area DA may include a plurality of pixels SP. The display area DA may include a plurality of pixel groups PG each including some pixels among the plurality of pixels SP. For example, each pixel group PG may correspond to a set of pixels SP arranged along corresponding rows and columns. The plurality of pixel groups PG may include a first-first pixel group PG11, a first-second pixel group PG12, a second-first pixel group PG21, and a second-second pixel group PG22. Each of the first-first pixel group PG11, the first-second pixel group PG12, the second-first pixel group PG21, and the second-second pixel group PG22 may include 2×2 pixels (2 by 2 pixels). However, the arrangement of the pixels SP in the pixel group is not limited thereto. Each of the plurality of pixel groups PG may correspond to a corresponding point in the display area DA. Therefore, the pixel group PG may correspond to a set of pixels SP arranged at the corresponding point in the display area DA.

For example, the display area DA may include a plurality of pixel blocks PB each including a plurality of pixel groups PG. The plurality of pixel blocks PB may include a first-first pixel block PB11 and a second-first pixel block PB21. The first-first pixel block PB11 may include the first-first pixel group PG11 and the first-second pixel group PG12. The second-first pixel block PB21 may include the second-first pixel group PG21 and the second-second pixel group PG22. Each of the plurality of pixel blocks PB may include 1×2 pixel groups PG and 2×4 pixels SP. However, the arrangement of the pixel groups PG or the pixels SP in the pixel block is not limited thereto. Therefore, the pixel block PB may correspond to a set of pixel groups PG corresponding to a corresponding point in the display area DA.

In another example, each of pixel blocks PB may include 3×3 pixel groups (3 by 3 pixel groups). In this case, the pixel block PB may correspond to a set of pixels SP that is greater in number than the pixel group PG, but might not correspond to a set of pixel groups PG.

Figure 7:
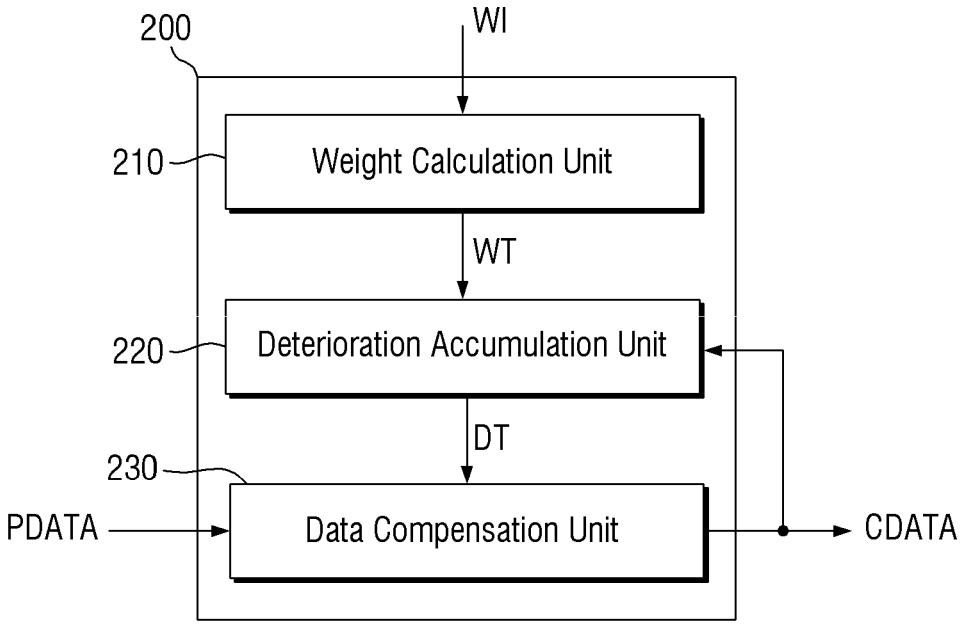
FIG. 7 is a block diagram showing a timing controller of a display device according to some embodiments.
Figure 8:
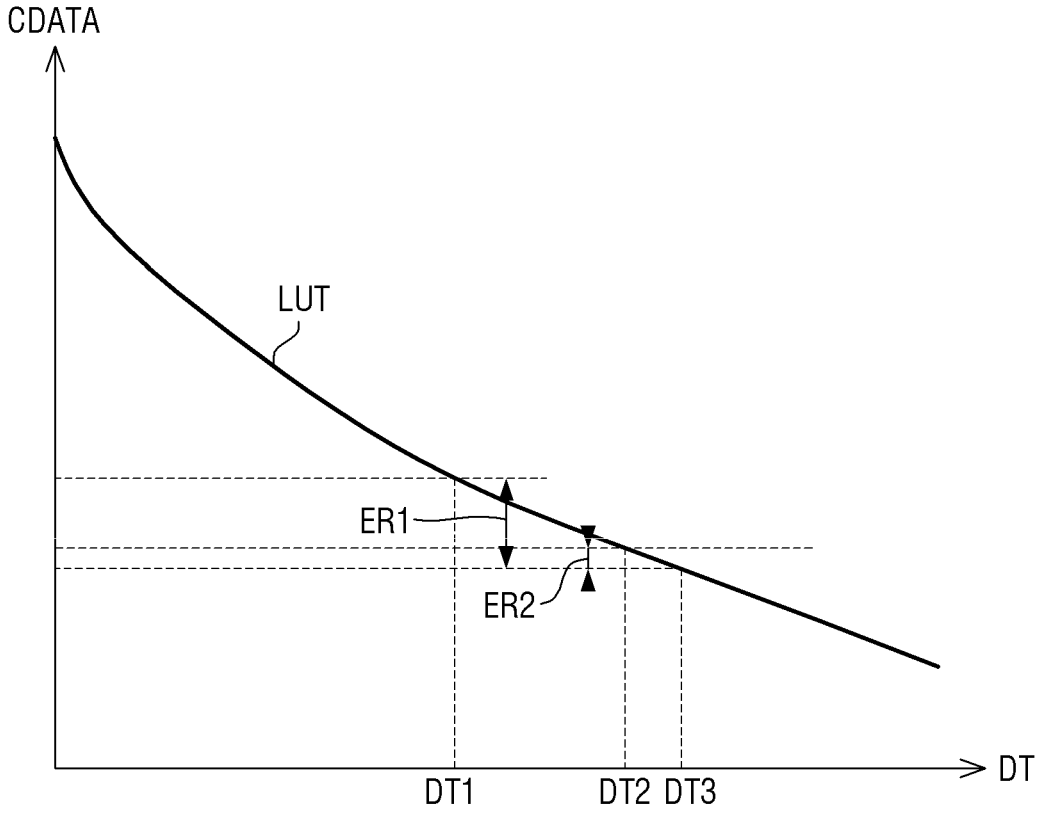
FIG. 8 is a graph showing a relationship between a deterioration amount and compensation data in a display device according to some embodiments.

FIG. 7 is a block diagram showing a timing controller of a display device according to some embodiments. FIG. 8 is a graph showing a relationship between a deterioration amount and compensation data in a display device according to some embodiments.

Referring to FIG. 7, the timing controller 200 may include a weight calculation unit 210, a deterioration accumulation unit 220, and a data compensation unit 230.

The weight calculation unit 210 may calculate a weight WT of each of pixels SP based on the weight information WI. When the plurality of pixels SP represent the same luminance, the weight information WI may include the amount of current flowing through each of pixels SP or the number of light emitting elements EL of each of pixels SP. Here, the amount of current flowing through each of the pixels SP may correspond to the magnitude of the driving current ID flowing through the output node OUT of the pixel circuit PC, or may correspond to the magnitude of the driving current ID supplied to the first electrodes of the plurality of light emitting elements EL. Further, the weight information WI may further include the luminance of the plurality of pixels SP, the temperature depending on the positions of the plurality of pixels SP, and/or the light emission periods and/or the light emission frequencies of the plurality of pixels SP, but is not limited thereto. The weight calculation unit 210 may calculate the magnitude of the current flowing through one light emitting element EL of a corresponding pixel SP based on the amount of current flowing through the pixel SP and the number of light emitting elements EL of the pixel SP. Therefore, the weight calculation unit 210 may calculate the weight WT of the corresponding pixel SP in consideration of the magnitude of the current flowing through each of light emitting elements EL of the pixel SP. For example, the weight WT calculated by the weight calculation unit 210 may become higher as the amount of current flowing through the pixel SP is increased, or as the number of light emitting elements EL is decreased, but is not limited thereto. The weight calculation unit 210 may supply the weight WT of each of pixels SP to the deterioration accumulation unit 220.

The deterioration accumulation unit 220 may accumulate a deterioration amount DT of the pixel SP based on the weight WT of the pixel SP and based on previous compensation data CDATA[n−1] of the pixel SP. Here, the previous compensation data CDATA[n−1] may correspond to the compensation data CDATA outputted by the data compensation unit 230 in the compensation stage in which the previous deterioration amount has been reflected. The deterioration accumulation unit 220 may calculate a previous age AGE[n−1] of the pixel SP corresponding to the previous compensation data CDATA[n−1] (e.g., see FIG. 12). The deterioration accumulation unit 220 may apply the weight WT to a current frame age AGE_Frame of the pixel SP, and may accumulate the weighted current frame age AGE_Frame to the previous age AGE[n−1] of the pixel SP. For example, a current age AGE[n] of the pixel SP may correspond to a value obtained by adding a product of the current frame age AGE_Frame and the weight WT to the previous age AGE[n−1] of the pixel SP (AGE[n]=AGE[n−1]+AGE_Frame×WT) The deterioration accumulation unit 220 may calculate the deterioration amount DT based on the current age AGE[n] of the pixel SP. Therefore, the deterioration accumulation unit 220 may calculate a current deterioration amount DT[n] of the pixel SP by applying the current frame age AGE_Frame and the weight WT to the previous deterioration amount DT[n−1] of the pixel SP. For example, the deterioration amount DT calculated by the deterioration accumulation unit 220 may be increased as the weight WT becomes higher or as the previous compensation data CDATA[n−1] becomes greater, but is not limited thereto.

The data compensation unit 230 may generate compensation data CDATA[n] to be supplied to each of pixels SP based on the deterioration amount DT of each of pixels SP. For example, the data compensation unit 230 may generate the compensation data CDATA[n] by applying the deterioration amount DT of each of pixels SP to a preset look-up table LUT. The data compensation unit 230 may supply the compensation data CDATA[n] to the data driver 300, and the data driver 300 may generate a data voltage based on the compensation data CDATA[n].

In FIG. 8, the display device may calculate a first deterioration amount DT1 based on the luminance of the plurality of pixels SP, may calculate the temperatures depending on the positions of the plurality of pixels SP, and/or may calculate the light emission periods and the emission frequencies of the plurality of pixels SP regardless of the amount of current flowing through the pixel SP and the number of light emitting elements EL of the pixel SP.

For example, because the display device may include the weight calculation unit 210, the deterioration accumulation unit 220, and the data compensation unit 230 shown in FIG. 7, it is possible to calculate a second deterioration amount DT2 based on the amount of current flowing through the pixel SP, the number of light emitting elements EL of the pixel SP, the luminance of the plurality of pixels SP, the temperatures depending on the positions of the plurality of pixels SP, and/or the light emission periods and/or the light emission frequencies of the plurality of pixels SP.

A first error ER1, which is between the compensation data CDATA generated based on the first deterioration amount DT1 and the compensation data CDATA generated based on an actual deterioration amount DT3 of the display device, may be greater than a second error ER2, which is between the compensation data CDATA generated based on the second deterioration amount DT2 and the compensation data CDATA generated based on the actual deterioration amount DT3. Here, the compensation data CDATA may be afterimage compensation data of the display device, and the first error ER1 or the second error ER2 may correspond to an afterimage compensation error. For example, when compensation data CDATA is generated based on the first deterioration amount DT1, the number of light emitting elements EL of the pixels SP is not applied, so that it might not be possible to accurately measure the deterioration amount of each of pixels SP, and the plurality of pixels SP might not be appropriately compensated. Therefore, when at least some pixels SP have different numbers of light emitting elements EL, the display device calculates the weights WT and the deterioration amounts DT of the pixels SP based on the amount of current flowing through the pixels SP and based on the number of light emitting elements EL of the pixels SP. Accordingly, it is possible to accurately calculate the deterioration amounts DT of the pixels SP, and to improve the afterimage compensation function of the display device.

Figure 9:
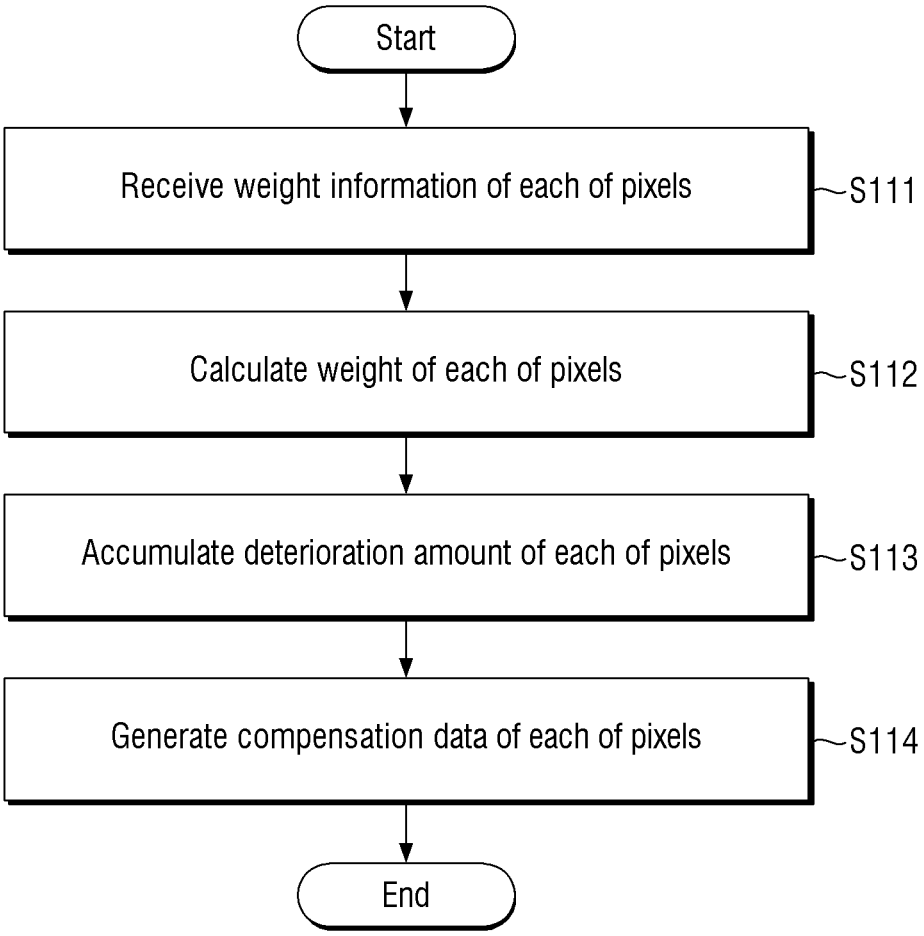
FIG. 9 is a flowchart illustrating an example of a process of generating compensation data in a display device according to some embodiments.

FIG. 9 is a flowchart illustrating an example of a process of generating compensation data in a display device according to some embodiments.

Referring to FIG. 9, the weight calculation unit 210 may receive the weight information WI supplied from the weight measurement system (operation S111). Here, when the pixels SP represent the same luminance, the weight information WI may include the amount of current flowing through each of pixels SP and/or the number of light emitting elements EL of each of pixels SP. Further, the weight information WI may further include the luminance of the plurality of pixels SP, the temperature depending on the positions of the plurality of pixels SP, and/or the light emission periods and/or the light emission frequencies of the plurality of pixels SP, but is not limited thereto.

The weight calculation unit 210 may calculate the weight WT of each of the pixels SP based on the weight information WI (operation S112). The weight calculation unit 210 may calculate the weight WT of the corresponding pixel SP in consideration of the magnitude of the current flowing through each of light emitting elements EL of the corresponding pixel SP. The weight calculation unit 210 may supply the weight WT of each of pixels SP to the deterioration accumulation unit 220.

The deterioration accumulation unit 220 may accumulate the deterioration amount DT of the pixel SP based on the weight WT of the pixel SP and the previous compensation data CDATA[n−1] of the pixel SP (operation S113). The deterioration accumulation unit 220 may calculate a current deterioration amount DT[n] of the pixel SP by applying the current frame age AGE_Frame and the weight WT to the previous deterioration amount DT[n−1] of the pixel SP.

The data compensation unit 230 may generate the compensation data CDATA[n] to be supplied to each of pixels SP based on the deterioration amount DT of each of pixels SP (operation S114). For example, the data compensation unit 230 may generate the compensation data CDATA[n] by applying the deterioration amount DT of each of pixels SP to a preset look-up table LUT.

Figure 10:
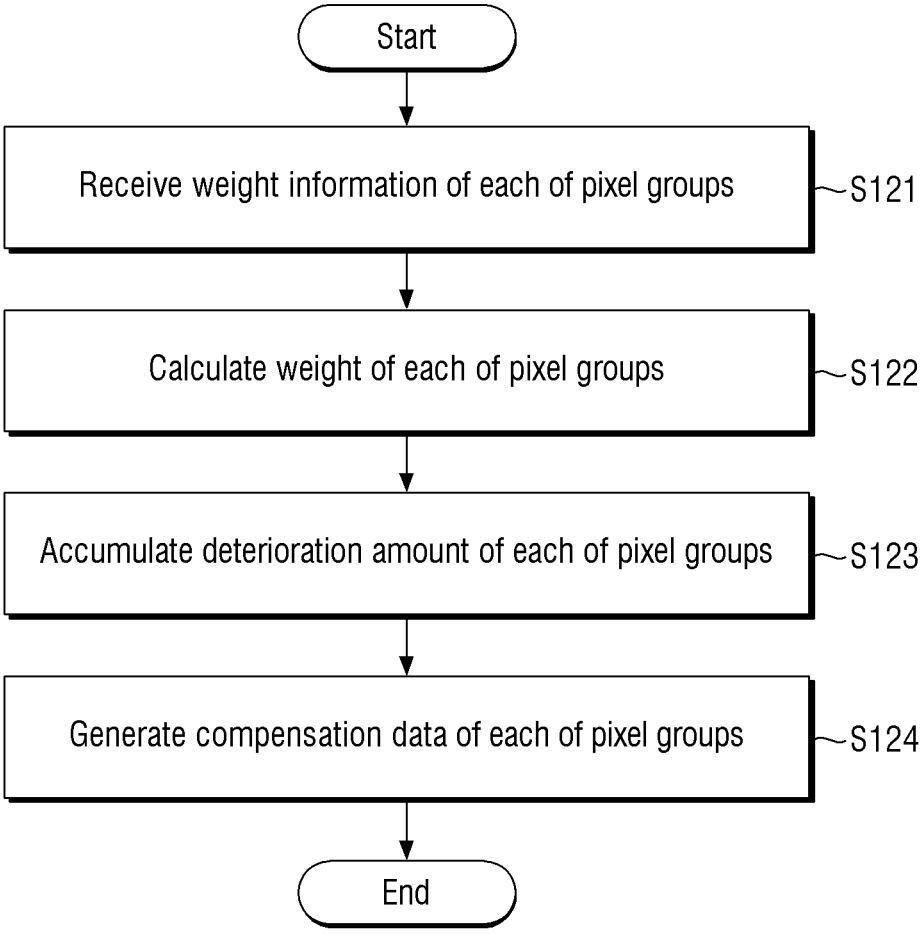
FIG. 10 is a flowchart illustrating another example of a process of generating compensation data in a display device according to some embodiments.

FIG. 10 is a flowchart illustrating another example of a process of generating compensation data in a display device according to some embodiments.

Referring to FIG. 10, the weight calculation unit 210 may receive the weight information WI of each of pixel groups PG (operation S121). For example, each pixel group PG may correspond to a set of pixels SP arranged along corresponding rows and columns. Further, the pixel group PG may correspond to a set of pixels SP arranged at the corresponding point in the display area DA. Therefore, when the plurality of pixel groups PG represent the same luminance, the weight information WI may include the amount of current flowing through each of pixel groups PG and/or the number of the light emitting elements EL of each of pixel groups PG. Further, the weight information WI may further include the luminance of the plurality of pixel groups PG, the temperatures depending on the positions of the plurality of pixel groups PG, and/or the light emission periods and/or the light emission frequencies of the plurality of pixel groups PG, but is not limited thereto.

The weight calculation unit 210 may calculate the weight WT of each of pixel groups PG based on the weight information WI (operation S122). The weight calculation unit 210 may calculate the weight WT of a corresponding pixel group PG in consideration of the magnitude of the current flowing through each of light emitting elements EL of the corresponding pixel group PG. The weight calculation unit 210 may supply the weight WT of each of pixel groups PG to the deterioration accumulation unit 220.

The deterioration accumulation unit 220 may accumulate the deterioration amount DT of the pixel group PG based on the weight WT of the pixel group PG and/or the previous compensation data CDATA[n−1] of the pixel group PG (operation S123). The deterioration accumulation unit 220 may calculate the current deterioration amount DT[n] of the pixel group PG by applying the current frame age AGE_Frame and the weight WT to the previous deterioration amount DT[n−1] of the pixel group PG.

The data compensation unit 230 may generate the compensation data CDATA[n] to be supplied to each of pixel groups PG based on the deterioration amount DT of each of pixel groups PG (operation S124). For example, the data compensation unit 230 may generate the compensation data CDATA[n] by applying the deterioration amount DT of each of pixel groups PG to the preset look-up table LUT.

Figure 11:
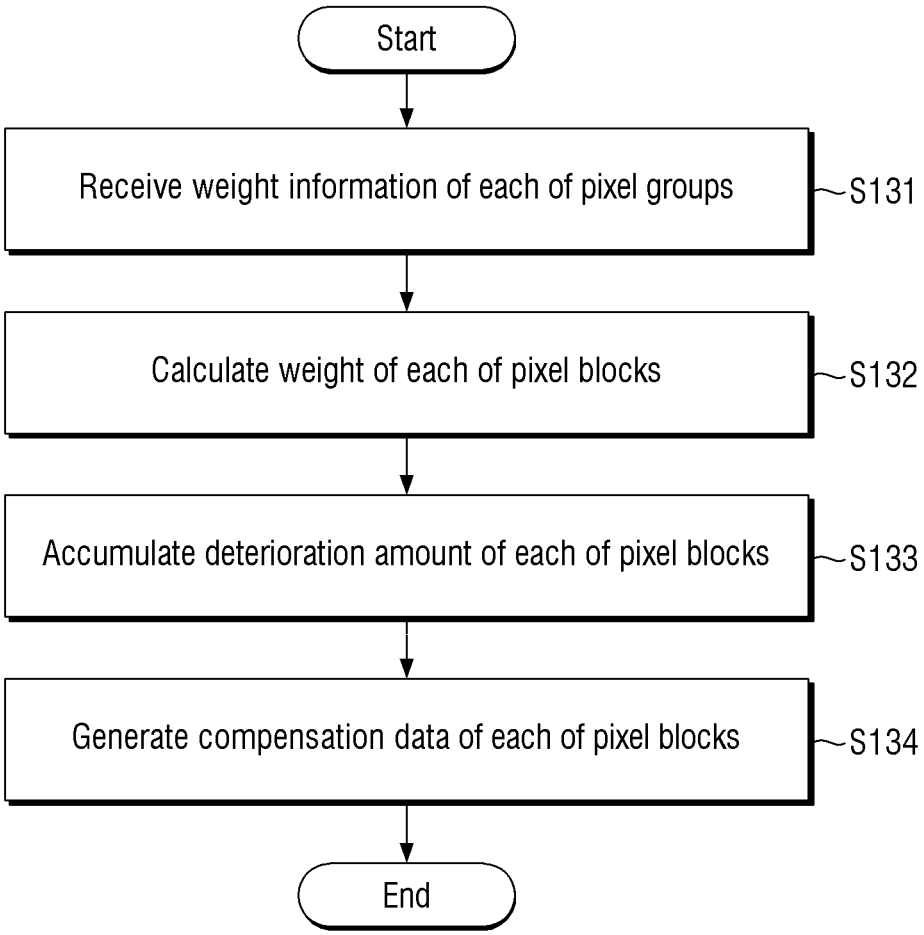
FIG. 11 is a flowchart illustrating still another example of a process of generating compensation data in a display device according to some embodiments.

FIG. 11 is a flowchart illustrating still another example of a process of generating compensation data in a display device according to some embodiments.

Referring to FIG. 11, the weight calculation unit 210 may receive the weight information WI of each of pixel groups PG (operation S131). For example, each pixel group PG may correspond to a set of pixels SP arranged along corresponding rows and columns. Further, the pixel group PG may correspond to a set of pixels SP arranged at a corresponding point in the display area DA. Therefore, when the plurality of pixel groups PG represent the same luminance, the weight information WI may include the amount of current flowing through each of pixel groups PG and/or the number of the light emitting elements EL of each of pixel groups PG. Further, the weight information WI may further include the luminance of the plurality of pixel groups PG, the temperatures depending on the positions of the plurality of pixel groups PG, and/or the light emission periods and/or the light emission frequencies of the plurality of pixel groups PG, but is not limited thereto.

The weight calculation unit 210 may calculate the weight WT of each pixel block PB including a plurality of pixel groups PG based on the weight information WI of the pixel group PG. (operation S132). For example, the pixel block PB may correspond to a set of pixel groups PG corresponding to a point in the display area DA. The weight calculation unit 210 may calculate the weight WT of a corresponding pixel block PB in consideration of the magnitude of the current flowing through each of light emitting elements EL of the corresponding pixel block PB. The weight calculation unit 210 may supply the weight WT of each of pixel blocks PB to the deterioration accumulation unit 220.

The deterioration accumulation unit 220 may accumulate the deterioration amount DT of the pixel block PB based on the weight WT of the pixel block PB and/or the previous compensation data CDATA[n−1] of the pixel block PB (operation S133). The deterioration accumulation unit 220 may calculate the current deterioration amount DT[n] of the pixel block PB by applying the current frame age AGE_Frame and/or the weight WT to the previous deterioration amount DT[n−1] of the pixel block PB.

The data compensation unit 230 may generate the compensation data CDATA[n] to be supplied to each of pixel blocks PB based on the deterioration amount DT of each of pixel blocks PB (operation S134). For example, the data compensation unit 230 may generate the compensation data CDATA[n] by applying the deterioration amount DT of each of pixel blocks PB to the preset look-up table LUT.

Figure 12:
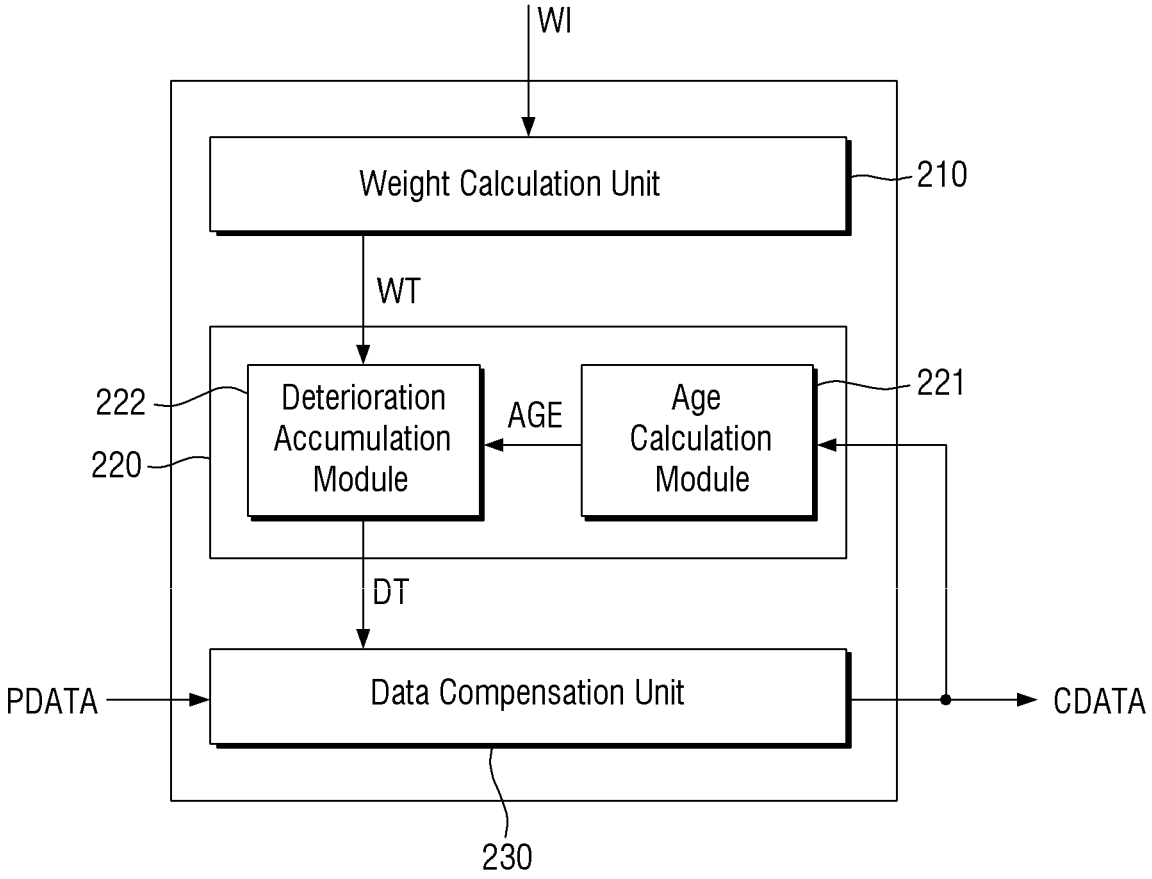
FIG. 12 is a block diagram illustrating a timing controller of a display device according to other embodiments.

FIG. 12 is a block diagram illustrating a timing controller of a display device according to other embodiments. The display device of FIG. 12 is different from the display device of FIG. 7 in the components of the deterioration accumulation unit 220, so that repeated description of the same components as the above-described components will be briefly mentioned or omitted.

Referring to FIG. 12, the timing controller 200 may include the weight calculation unit 210, the deterioration accumulation unit 220, and the data compensation unit 230.

The weight calculation unit 210 may calculate a weight WT of each of pixels SP based on the weight information WI. When the plurality of pixels SP represent the same luminance, the weight information WI may include the amount of current flowing through each of pixels SP or the number of light emitting elements EL of each of pixels SP. The weight calculation unit 210 may calculate the weight WT of the corresponding pixel SP in consideration of the magnitude of the current flowing through each of light emitting elements EL of the corresponding pixel SP.

The deterioration accumulation unit 220 may include an age calculation module 221 and a deterioration accumulation module 222.

The age calculation module 221 may calculate the previous age AGE[n−1] of each of pixels SP corresponding to the previous compensation data CDATA[n−1] of each of pixels SP. Here, the previous compensation data CDATA[n−1] may correspond to the compensation data CDATA[n−1] outputted by the data compensation unit 230 in the compensation stage in which the previous deterioration amount has been reflected. The age calculation module 221 may calculate the current age AGE[n] based on the previous age AGE[n−1] and a current fame age AGE_Frame of the pixel SP. For example, the age calculation module 221 may calculate the current age AGE[n] by adding the current frame age AGE_Frame of the pixel SP to the previous age AGE[n−1] of the pixel SP (AGE[n]=AGE[n−1]+AGE_Frame).

The deterioration accumulation module 222 may accumulate the deterioration amount DT[n] of the pixel SP based on the weight WT of the pixel SP and the current age AGE[n] of the pixel SP. The deterioration accumulation module 222 may calculate the current deterioration amount DT[n] of the pixel SP by applying the weight WT of the pixel SP to the current age AGE[n] of the pixel SP.

Because the deterioration accumulation unit 220 includes the age calculation module 221 and the deterioration accumulation module 222, it is possible to apply the previous compensation data CDATA and the weight WT in stages, and to reduce the calculation load of the deterioration accumulation unit 220.

The data compensation unit 230 may generate the compensation data CDATA[n] to be supplied to each of pixels SP based on the deterioration amount DT[n] of each of pixels SP. For example, the data compensation unit 230 may generate the compensation data CDATA[n] by applying the deterioration amount DT[n] of each of pixels SP to the preset look-up table LUT.

Figure 13:
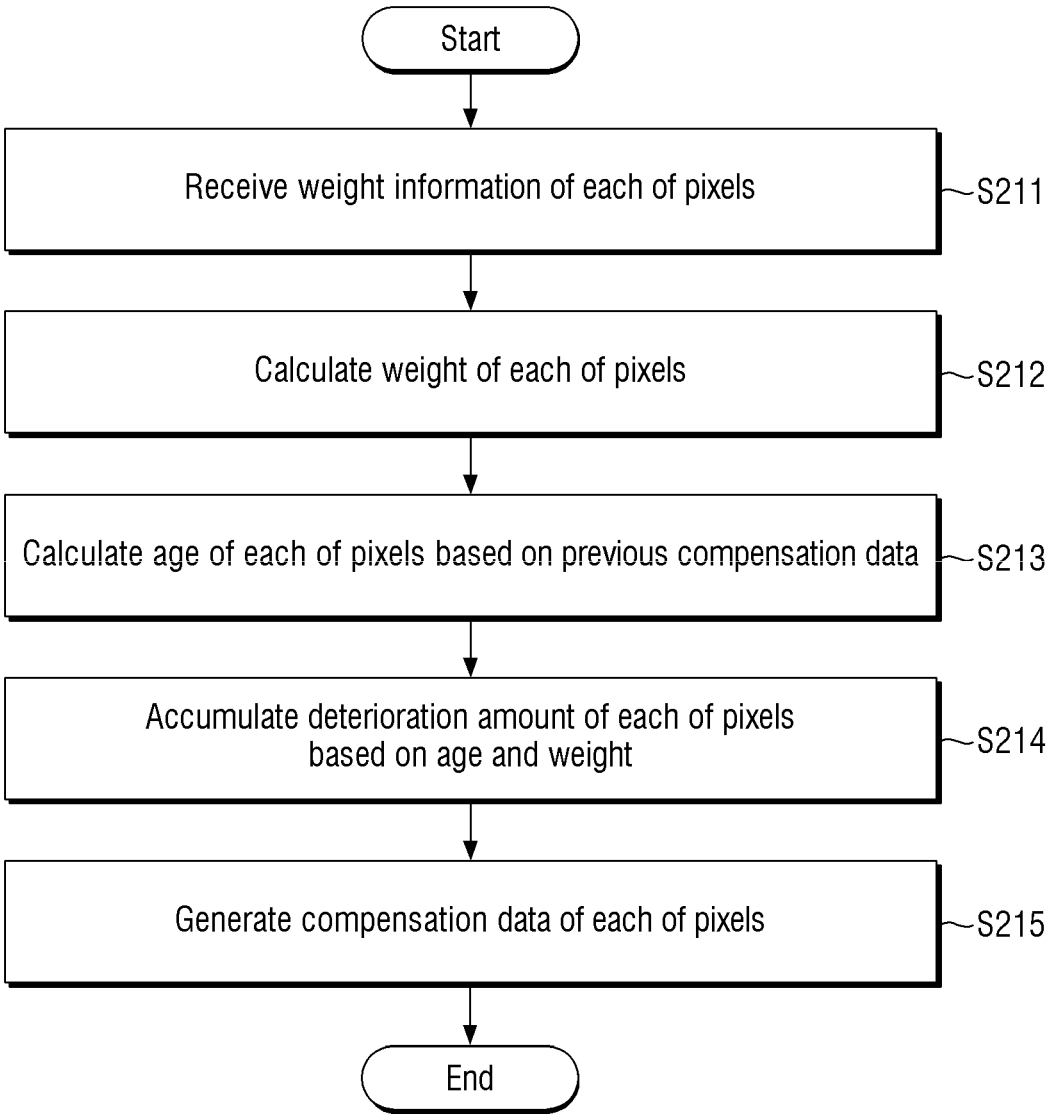
FIG. 13 is a flowchart illustrating an example of a process of generating compensation data in a display device according to other embodiments.

FIG. 13 is a flowchart illustrating an example of a process of generating compensation data in a display device according to other embodiments.

Referring to FIG. 13, the weight calculation unit 210 may receive the weight information WI supplied from a weight measurement system (operation S211). Here, when the plurality of pixels SP represent the same luminance, the weight information WI may include the amount of current flowing through each of pixels SP and the number of light emitting elements EL of each of pixels SP.

The weight calculation unit 210 may calculate the weight WT of each of pixels SP based on the weight information WI (operation S212). The weight calculation unit 210 may calculate the weight WT of the corresponding pixel SP in consideration of the magnitude of the current flowing through each of light emitting elements EL of the pixel SP.

The age calculation module 221 may calculate the age AGE of each of pixels SP based on the previous compensation data CDATA[n−1] of each of the pixels SP (operation S213). The age calculation module 221 may calculate the previous age AGE[n−1] corresponding to the previous compensation data CDATA[n−1] of the pixel SP. The age calculation module 221 may calculate the current age AGE[n] based on the previous age AGE[n−1] and the current frame age AGE_Frame of the pixel SP.

The deterioration accumulation module 222 may accumulate the deterioration amount DT[n] of the pixel SP based on the current age AGE[n] of the pixel SP and the weight WT of the pixel SP (operation S214). The deterioration accumulation module 222 may calculate the current deterioration amount DT[n] of the pixel SP by applying the weight WT of the pixel SP to the current age AGE[n] of the pixel SP.

The data compensation unit 230 may generate the compensation data CDATA[n] to be supplied to each of pixels SP based on the deterioration amount DT[n] of each of pixels SP (operation S215). For example, the data compensation unit 230 may generate the compensation data CDATA[n] by applying the deterioration amount DT[n] of each of pixels SP to the preset look-up table LUT.

Figure 14:
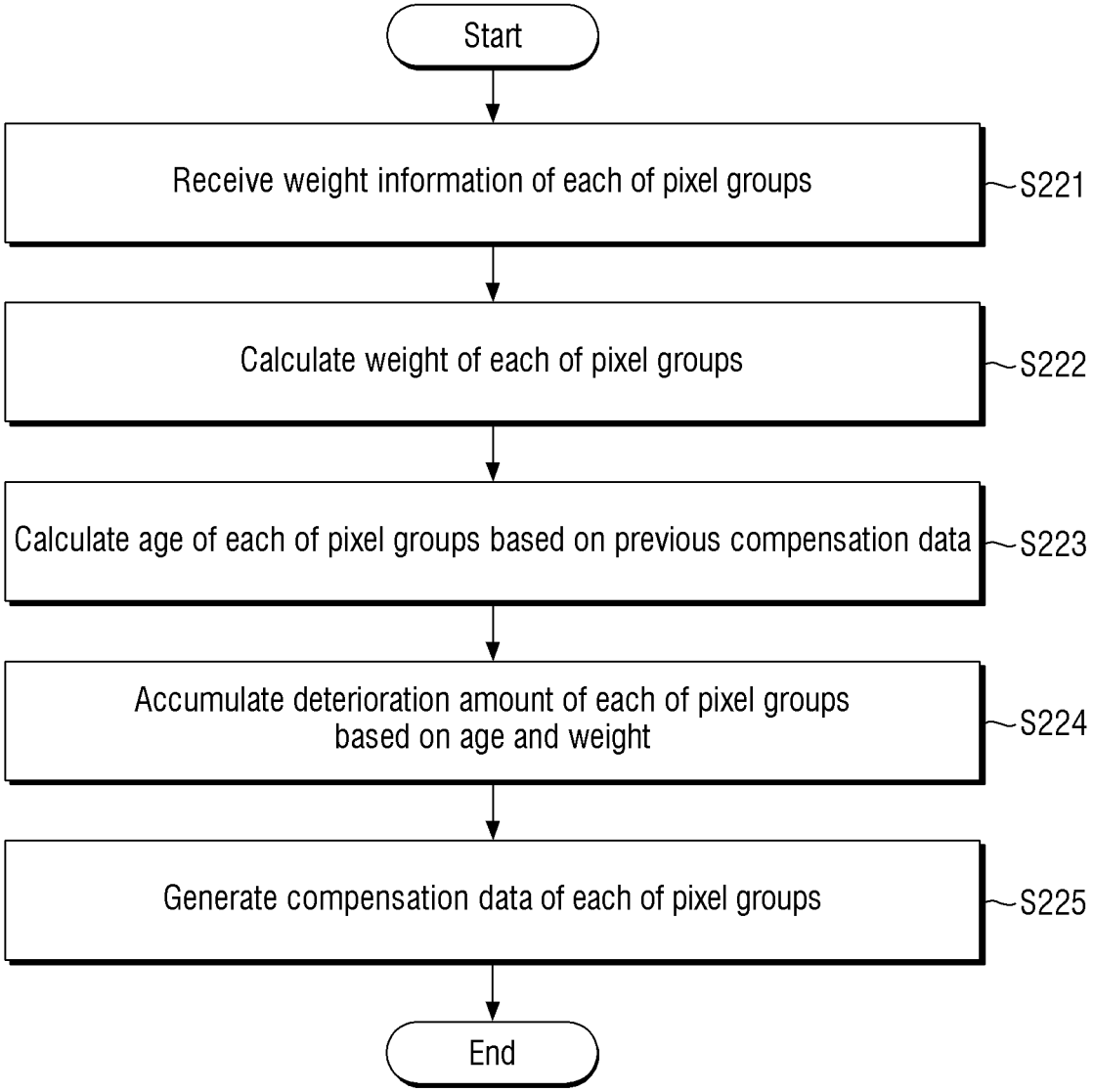
FIG. 14 is a flowchart illustrating another example of a process of generating compensation data in a display device according to other embodiments.

FIG. 14 is a flowchart illustrating another example of a process of generating compensation data in a display device according to other embodiments.

Referring to FIG. 14, the weight calculation unit 210 may receive the weight information WI of each of pixel groups PG (operation S221). For example, each pixel group PG may correspond to a set of pixels SP arranged along corresponding rows and columns. Further, the pixel group PG may correspond to a set of pixels SP arranged at the corresponding point in the display area DA. Therefore, when the plurality of pixel groups PG represent the same luminance, the weight information WI may include the amount of current flowing through each of pixel groups PG and/or the number of the light emitting elements EL of each of pixel groups PG.

The weight calculation unit 210 may calculate the weight WT of each of pixel groups PG based on the weight information WI (operation S222). The weight calculation unit 210 may calculate the weight WT of a corresponding pixel group PG in consideration of the magnitude of the current flowing through each of light emitting elements EL of the corresponding pixel group PG.

The age calculation module 221 may calculate the age AGE of each of pixel groups PG based on the previous compensation data CDATA[n−1] of each of pixel groups PG (operation S223). The age calculation module 221 may calculate the previous age AGE[n−1] corresponding to the previous compensation data CDATA[n−1] of the pixel group PG. The age calculation module 221 may calculate the current age AGE[n] of the pixel group PG based on the previous age AGE[n−1] and the current frame age AGE_Frame of the pixel group PG.

The deterioration accumulation module 222 may accumulate the deterioration amount DT[n] of the pixel group PG based on the current age AGE[n] of the pixel group PG and the weight WT of the pixel group PG (operation S224). The deterioration accumulation module 222 may calculate the current deterioration amount DT[n] of the pixel group PG by applying the weight WT of the pixel group PG to the current age AGE[n] of the pixel group PG.

The data compensation unit 230 may generate the compensation data CDATA[n] to be supplied to each of pixel groups PG based on the deterioration amount DT[n] of each of pixel groups PG (operation S225). For example, the data compensation unit 230 may generate the compensation data CDATA[n] by applying the deterioration amount DT[n] of each of pixel groups PG to the preset look-up table LUT.

Figure 15:
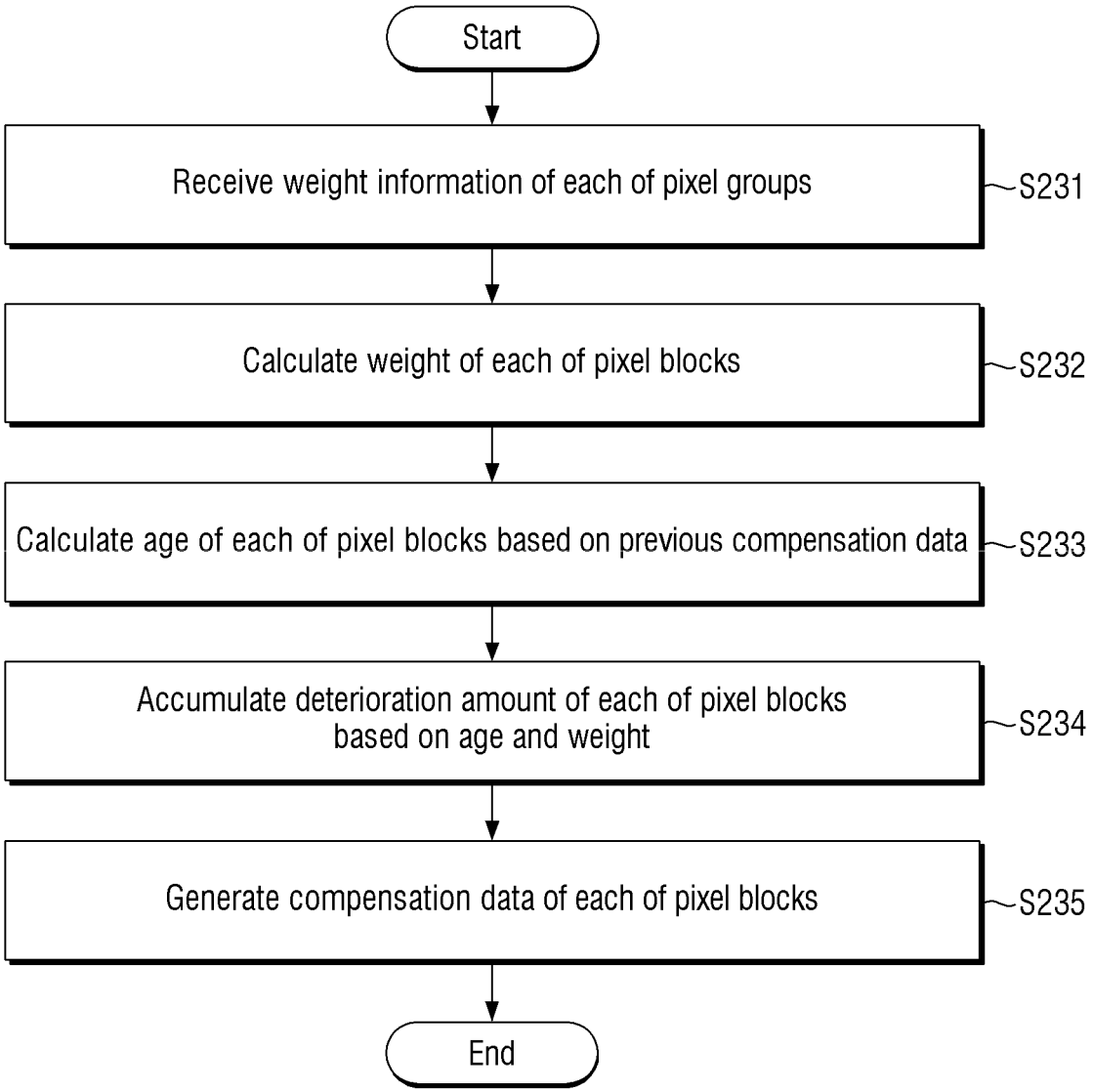
FIG. 15 is a flowchart illustrating still another example of a process of generating compensation data in a display device according to other embodiments.

FIG. 15 is a flowchart illustrating still another example of a process of generating compensation data in a display device according to other embodiments.

Referring to FIG. 15, the weight calculation unit 210 may receive the weight information WI of each of pixel groups PG (operation S231). For example, each pixel group PG may correspond to a set of pixels SP arranged along corresponding rows and columns. Further, the pixel group PG may correspond to a set of pixels SP arranged at a corresponding point in the display area DA. Therefore, when the pixel groups PG represent the same luminance, the weight information WI may include the amount of current flowing through each of pixel groups PG and/or the number of the light emitting elements EL of each of pixel groups PG.

The weight calculation unit 210 may calculate the weight WT of each pixel block PB including a plurality of pixel groups PG based on the weight information WI of the pixel group PG (operation S232). For example, the pixel block PB may correspond to a set of pixel groups PG corresponding to a point in the display area DA. The weight calculation unit 210 may calculate the weight WT of a corresponding pixel block PB in consideration of the magnitude of the current flowing through each of light emitting elements EL of the corresponding pixel block PB.

The age calculation module 221 may calculate the age AGE of each of pixel blocks PB based on the previous compensation data CDATA[n−1] of each of pixel blocks PB (operation S233). The age calculation module 221 may calculate the previous age AGE[n−1] corresponding to the previous compensation data CDATA[n−1] of the pixel block PB. The age calculation module 221 may calculate the current age AGE[n] of the pixel block PB based on the previous age AGE[n−1] and the current frame age AGE_Frame of the pixel block PB.

The deterioration accumulation module 222 may accumulate the deterioration amount DT[n] of the pixel block PB based on the current age AGE[n] of the pixel block PB and/or the weight WT of the pixel block PB (operation S234). The deterioration accumulation module 222 may calculate the current deterioration amount DT[n] of the pixel block PB by applying the weight WT of the pixel block PB to the current age AGE[n] of the pixel block PB.

The data compensation unit 230 may generate the compensation data CDATA[n] to be supplied to each of pixel blocks PB based on the deterioration amount DT[n] of each of pixel blocks PB (operation S235). For example, the data compensation unit 230 may generate the compensation data CDATA[n] by applying the deterioration amount DT[n] of each of pixel blocks PB to the preset look-up table LUT.

Figure 16:
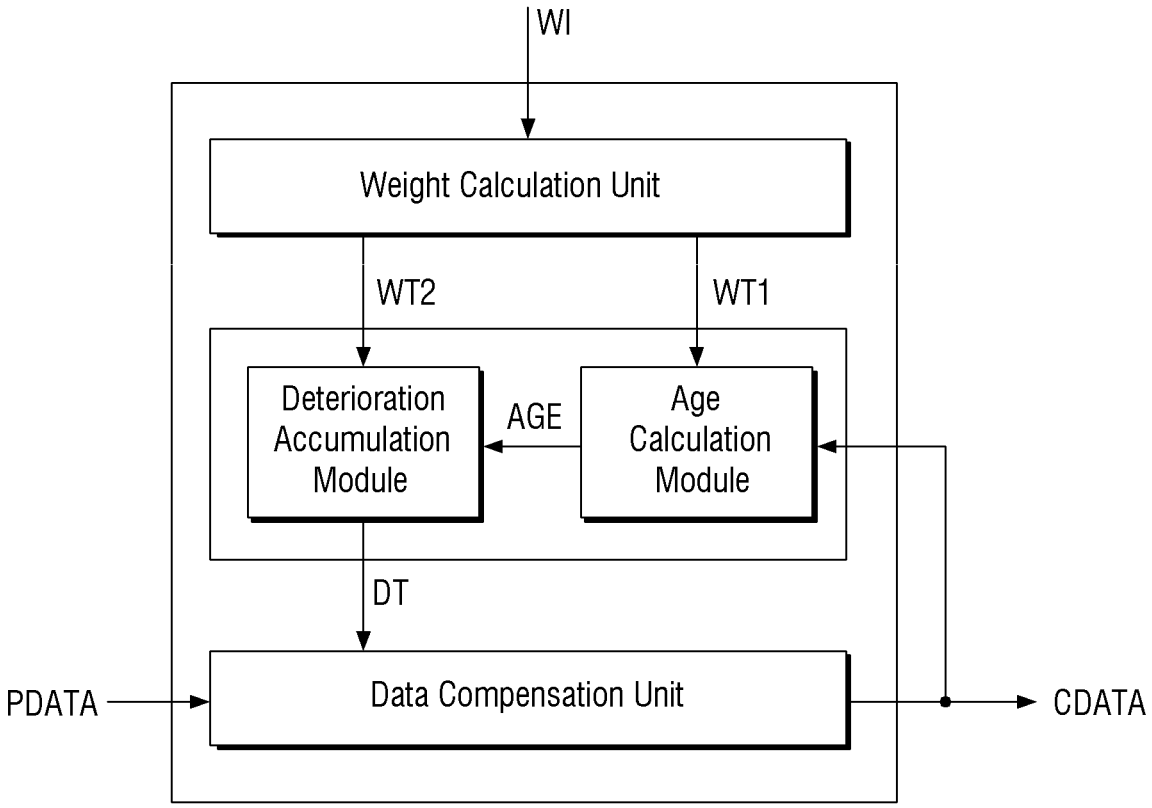
FIG. 16 is a block diagram illustrating a timing controller of a display device according to still other embodiments.

FIG. 16 is a block diagram illustrating a timing controller of a display device according to still other embodiments. The display device of FIG. 16 is different from the display device of FIG. 7 or the display device of FIG. 12 with respect to the components of the deterioration accumulation unit 220, so that repeated description of the same components as the above-described components will be mentioned briefly or omitted.

Referring to FIG. 16, the timing controller 200 may include the weight calculation unit 210, the deterioration accumulation unit 220, and the data compensation unit 230.

The weight calculation unit 210 may calculate a first weight WT1 and a second weight WT2 of each of pixels SP based on the weight information WI. When the plurality of pixels SP represent the same luminance, the weight information WI may include the amount of current flowing through each of pixels SP or the number of light emitting elements EL of each of pixels SP. The weight calculation unit 210 may calculate the first weight WT1 and the second weight WT2 of a corresponding pixel SP in consideration of the magnitude of the current flowing through each of light emitting elements EL of the corresponding pixel SP.

The deterioration accumulation unit 220 may include the age calculation module 221 and the deterioration accumulation module 222.

The age calculation module 221 may calculate the age AGE of each of pixels SP based on the first weight WT1 of the pixel SP and the previous compensation data CDATA [n−1] of the pixel SP. Here, the previous compensation data CDATA[n−1] may correspond to the compensation data CDATA[n−1] outputted by the data compensation unit 230 in the compensation stage in which the previous deterioration amount has been reflected. The age calculation module 221 may calculate the previous age AGE[n−1] corresponding to the previous compensation data CDATA[n−1] of the pixel SP. The age calculation module 221 may apply the first weight WT1 to the current frame age AGE_Frame of the pixel SP and may accumulate the weighted current frame age AGE_Frame to the previous age AGE[n−1] of the pixel SP. For example, the current age AGE[n] of the pixel SP may correspond to a value obtained by adding the product of the current frame age AGE_Frame and the first weight WT1 to the previous age AGE[n−1] of the pixel SP (AGE[n]=AGE [n−1]+AGE_Frame×WT1). Therefore, the age calculation module 221 may calculate the current age AGE[n] by applying the current frame age AGE_Frame and the first weight WT1 to the previous age AGE[n−1] of the pixel SP.

The deterioration accumulation module 222 may accumulate the deterioration amount DT[n] of the pixel SP based on the second weight WT2 of the pixel SP and the current age AGE[n] of the pixel SP. The deterioration accumulation module 222 may calculate the current deterioration amount DT[n] of the pixel SP by applying the second weight WT2 of the pixel SP to the current age AGE[n] of the pixel SP. For example, the current deterioration amount DT[n] of the pixel SP may correspond to the product of the current age AGE[n] of the pixel SP and the second weight WT2 (DT[n]=AGE [n]×WT2). Therefore, the deterioration accumulation module 222 may calculate the current deterioration amount DT[n] by applying the second weight WT2 to the current age AGE[n] of the pixel SP.

Because the deterioration accumulation unit 220 includes the age calculation module 221 and the deterioration accumulation module 222, it is possible to apply the previous compensation data CDATA and the first and the second weights WT1 and WT2 in stages, and to reduce the calculation load of the deterioration accumulation unit 220.

The data compensation unit 230 may generate the compensation data CDATA[n] to be supplied to each of the pixels SP based on the deterioration amount DT[n] of each of pixels SP. For example, the data compensation unit 230 may generate the compensation data CDATA[n] by applying the deterioration amount DT[n] of each of pixels SP to the preset look-up table LUT.

Figure 17:
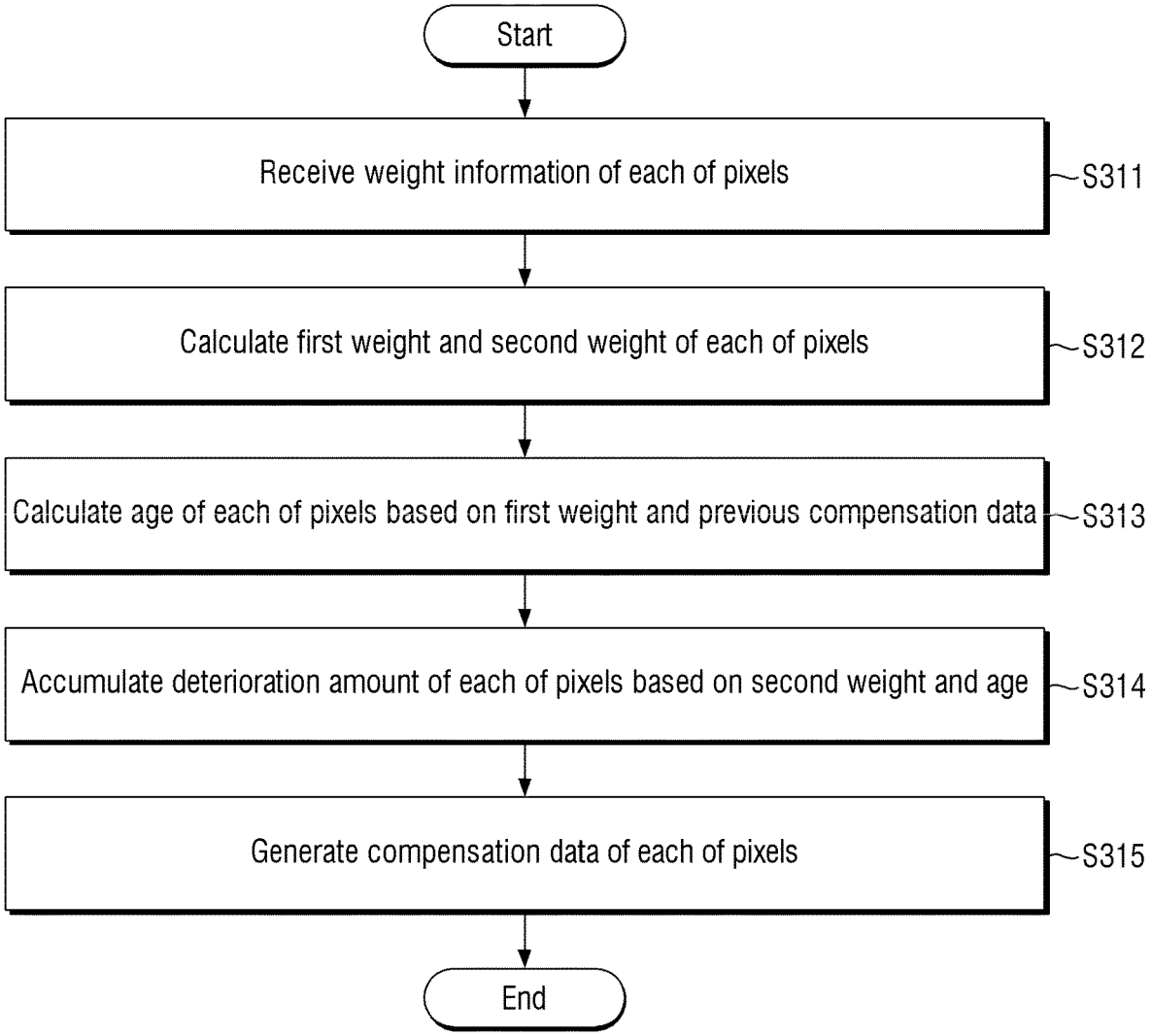
FIG. 17 is a flowchart illustrating an example of a process of generating compensation data in a display device according to still other embodiments.

FIG. 17 is a flowchart illustrating an example of a process of generating compensation data in a display device according to still other embodiments.

Referring to FIG. 17, the weight calculation unit 210 may receive the weight information WI supplied from the weight measurement system (operation S311). Here, when the plurality of pixels SP represent the same luminance, the weight information WI may include the amount of current flowing through each of pixels SP and the number of light emitting elements EL of each of pixels SP.

The weight calculation unit 210 may calculate the first weight WT1 and the second weight WT2 of each of pixels SP based on the weight information WI (operation S312). The weight calculation unit 210 may calculate the first weight WT1 and the second weight WT2 of a corresponding pixel SP in consideration of the magnitude of the current flowing through each of light emitting elements EL of the corresponding pixel SP.

The age calculation module 221 may calculate the age AGE of each of pixels SP based on the first weight WT1 of the pixel SP and the previous compensation data CDATA [n−1] of the pixel SP (operation S313). The age calculation module 221 may calculate the current age AGE[n] of the pixel SP by applying the first weight WT1 and the current frame age AGE_Frame to the previous age AGE[n−1] of the pixel SP.

The deterioration accumulation module 222 may accumulate the deterioration amount DT[n] of the pixel SP based on the second weight WT2 of the pixel SP and/or the current age AGE[n] of the pixel SP (operation S314). The deterioration accumulation module 222 may calculate the current deterioration amount DT[n] of the pixel SP by applying the second weight WT2 of the pixel SP to the current age AGE[n] of the pixel SP.

The data compensation unit 230 may generate the compensation data CDATA[n] to be supplied to each of pixels SP based on the deterioration amount DT[n] of each of pixels SP (operation S315). For example, the data compensation unit 230 may generate the compensation data CDATA[n] by applying the deterioration amount DT[n] of each of pixels SP to the preset look-up table LUT.

Figure 18:
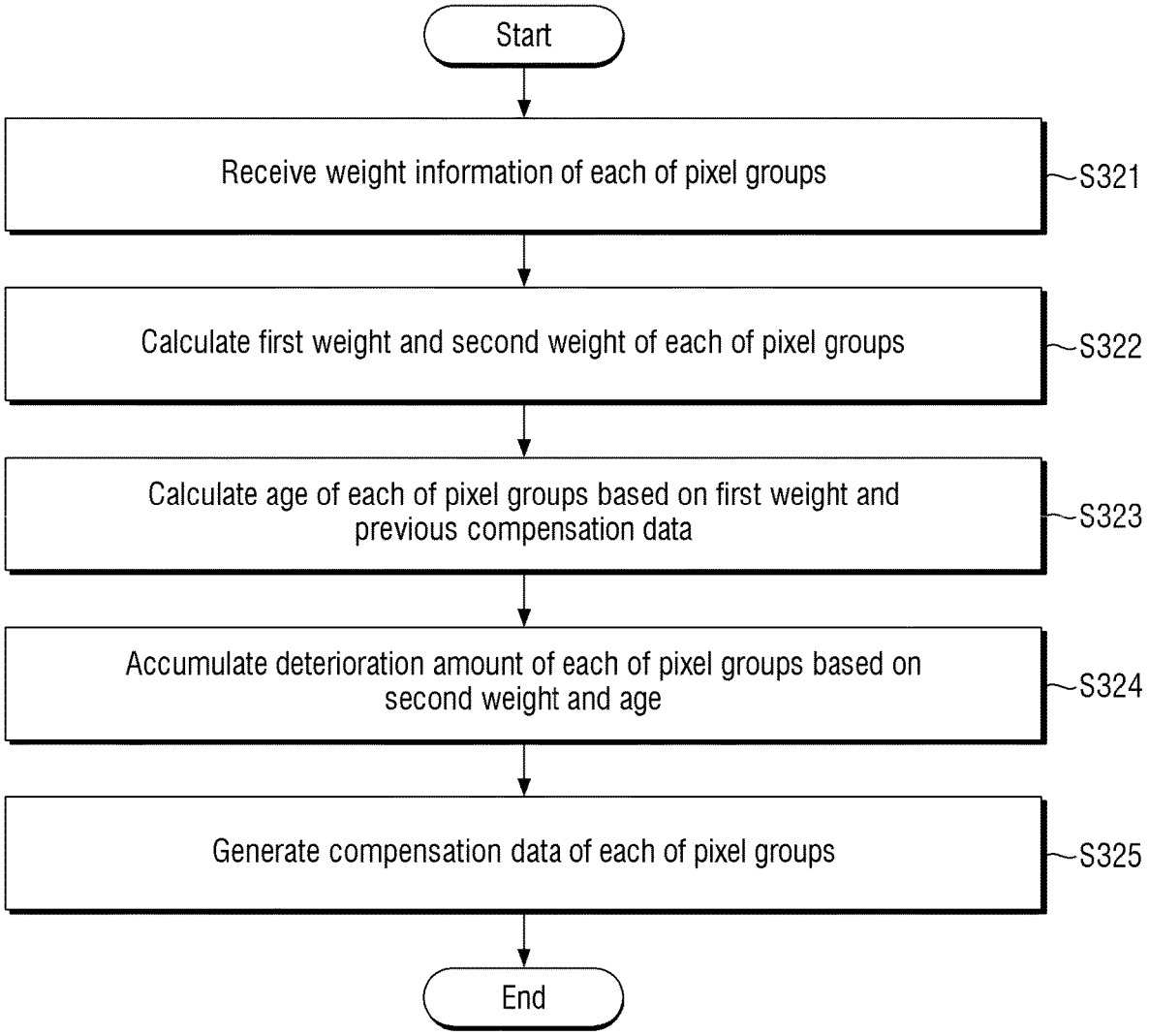
FIG. 18 is a flowchart illustrating another example of a process of generating compensation data in a display device according to still other embodiments.

FIG. 18 is a flowchart illustrating another example of a process of generating compensation data in a display device according to still other embodiments.

Referring to FIG. 18, the weight calculation unit 210 may receive the weight information WI of each of pixel groups PG (operation S321). For example, each pixel group PG may correspond to a set of pixels SP arranged along corresponding rows and columns. Further, the pixel group PG may correspond to a set of pixels SP arranged at the corresponding point in the display area DA. Therefore, when the plurality of pixel groups PG represent the same luminance, the weight information WI may include the amount of current flowing through each of pixel groups PG and the number of the light emitting elements EL of each of pixel groups PG.

The weight calculation unit 210 may calculate the first weight WT1 and the second weight WT2 of each of pixel groups PG based on the weight information WI (operation S322). The weight calculation unit 210 may calculate the first weight WT1 and the second weight WT2 of a corresponding pixel group PG in consideration of the magnitude of the current flowing through each of light emitting elements EL of the corresponding pixel group PG.

The age calculation module 221 may calculate the age AGE of each of pixel groups PG based on the first weight WT1 of the pixel group PG and/or the previous compensation data CDATA[n−1] of the pixel group PG (operation S323). The age calculation module 221 may calculate the current age AGE[n] of the pixel group PG by applying the first weight WT1 of the pixel group PG and the current frame age AGE_Frame of the pixel group PG to the previous age AGE[n−1] of the pixel group PG.

The deterioration accumulation module 222 may accumulate the deterioration amount DT[n] of the pixel group PG based on the second weight WT2 of the pixel group PG and/or the current age AGE[n] of the pixel group PG (operation S324). The deterioration accumulation module 222 may calculate the current deterioration amount DT[n] of the pixel group PG by applying the second weight WT2 of the pixel group PG to the current age AGE[n] of the pixel group PG.

The data compensation unit 230 may generate the compensation data CDATA[n] to be supplied to each of pixel groups PG based on the deterioration amount DT[n] of each of pixel groups PG (operation S325). For example, the data compensation unit 230 may generate the compensation data CDATA[n] by applying the deterioration amount DT[n] of each of pixel groups PG to the preset look-up table LUT.

Figure 19:
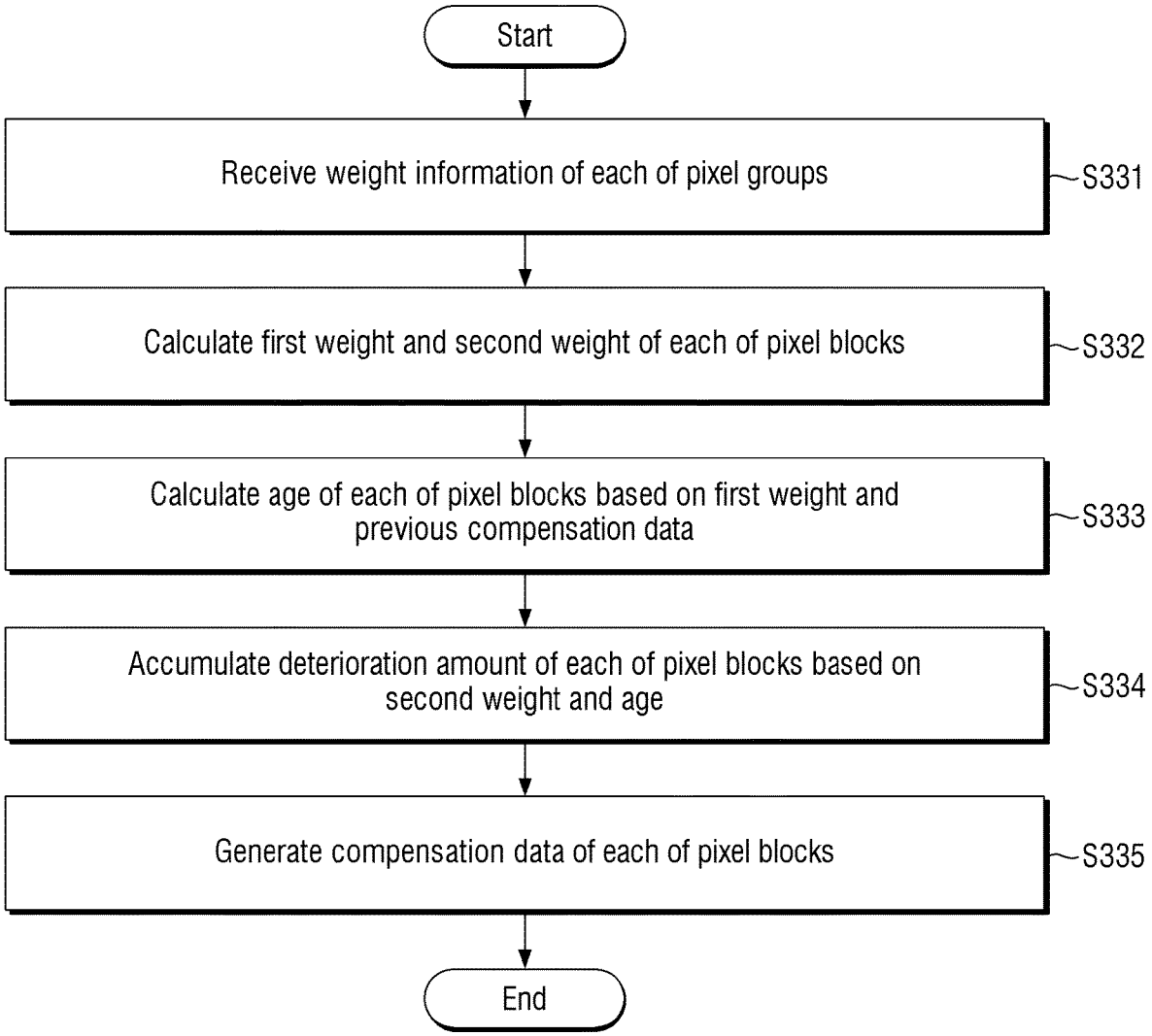
FIG. 19 is a flowchart illustrating still another example of a process of generating compensation data in a display device according to still other embodiments.

FIG. 19 is a flowchart illustrating still another example of a process of generating compensation data in a display device according to still other embodiments.

Referring to FIG. 19, the weight calculation unit 210 may receive the weight information WI of each of the pixel groups PG (operation S331). For example, each pixel group PG may correspond to a set of pixels SP arranged along corresponding rows and columns. Further, the pixel group PG may correspond to a set of pixels SP arranged at the corresponding point in the display area DA. Therefore, when the plurality of pixel groups PG represent the same luminance, the weight information WI may include the amount of current flowing through each of pixel groups PG and the number of the light emitting elements EL of each of pixel groups PG.

The weight calculation unit 210 may calculate the first weight WT1 and the second weight WT2 of each of the pixel blocks PB based on the weight information WI of the pixel group PG (operation S332). The weight calculation unit 210 may calculate the first weight WT1 and the second weight WT2 of a corresponding pixel block PB in consideration of the magnitude of the current flowing through each of light emitting elements EL of the corresponding pixel block PB.

The age calculation module 221 may calculate the age AGE of each of blocks PB based on the first weight WT1 of the pixel block PB and the previous compensation data CDATA[n−1] of the pixel block PB (operation S333). The age calculation module 221 may calculate the current age AGE[n] of the pixel block PB by applying the first weight WT1 of the pixel block PB and the current frame age AGE_Frame to the previous age AGE[n−1] of the pixel block PB.

The deterioration accumulation module 222 may accumulate the deterioration amount DT[n] of the pixel block PB based on the second weight WT2 of the pixel block PB and the current age AGE[n] of the pixel block PB (operation S334). The deterioration accumulation module 222 may calculate the current deterioration amount DT[n] of the pixel block PB by applying the second weight WT2 of the pixel block PB to the current age AGE[n] of the pixel block PB.

The data compensation unit 230 may generate the compensation data CDATA[n] to be supplied to each of pixel blocks PB based on the deterioration amount DT[n] of each of pixel blocks PB (operation S335). For example, the data compensation unit 230 may generate the compensation data CDATA[n] by applying the deterioration amount DT[n] of each of pixel blocks PB to the preset look-up table LUT.

What is claimed is:

1. A display device comprising:

pixels comprising light emitting elements;

a weight calculation unit configured to calculate a weight of one of the pixels based on an amount of current flowing therethrough and a number of light emitting elements thereof;

a deterioration accumulation unit configured to accumulate a deterioration amount of the one of the pixels based on the weight and previous compensation data thereof; and a data compensation unit configured to generate compensation data to be supplied to the one of the pixels based on the deterioration amount thereof.

2. The display device of claim 1, wherein at least some of the pixels have different numbers of light emitting elements.

3. The display device of claim 1, wherein the weight calculated by the weight calculation unit becomes higher as the amount of current flowing is larger, or as the number of light emitting elements is smaller.

4. The display device of claim 1, wherein the deterioration accumulation unit is configured to accumulate a current deterioration amount of the one of the pixels by accumulating a product of a current frame age and the weight to a previous deterioration amount of the pixel.

5. The display device of claim 1, wherein the deterioration amount calculated by the deterioration accumulation unit increases as the weight becomes higher or as the previous compensation data becomes greater.

6. The display device of claim 1, wherein the data compensation unit is configured to generate the compensation data by applying the deterioration amount to a preset look-up table.

7. The display device of claim 1, wherein the weight calculation unit is configured to calculate a weight of a pixel group comprising some of the pixels based on an amount of current flowing through the pixel group and a number of light emitting elements in the pixel group.

8. The display device of claim 7, further comprising a display area comprising the pixels, and a non-display area surrounding the display area, wherein the pixel group corresponds to a corresponding point in the display area.

9. The display device of claim 1, wherein the weight calculation unit is configured to calculate a weight of a pixel block comprising pixel groups having some of the pixels based on an amount of current flowing through the pixel group and the number of light emitting elements in the pixel group.

10. The display device of claim 1, wherein the pixels further comprise a pixel circuit connected to a data line, a gate line, and a driving voltage line, and wherein the light emitting elements are connected between an output node of the pixel circuit and a low potential line.

11. The display device of claim 1, wherein the deterioration accumulation unit comprises:

an age calculation module configured to calculate an age of the one of the pixels based on previous compensation data thereof; and a deterioration accumulation module configured to accumulate a deterioration amount of the one of the pixels based on the weight and the age thereof.

12. The display device of claim 11, wherein the weight calculation unit is configured to calculate a weight of a pixel group having some of the pixels based on an amount of current flowing through the pixel group, and the number of light emitting elements in the pixel group.

13. The display device of claim 12, wherein the deterioration accumulation module is configured to accumulate a deterioration amount of the pixel group by applying a weight of the pixel group to an age of the pixel group.

14. The display device of claim 11, wherein the weight calculation unit is configured to calculate a weight of a pixel block comprising pixel groups having some of the pixels based on an amount of current flowing through the pixel group, and the number of light emitting elements in the pixel group.

15. The display device of claim 14, wherein the deterioration accumulation module is configured to accumulate a deterioration amount of the pixel block by applying the weight of the pixel block to an age of the pixel block.

16. The display device of claim 1, wherein the deterioration accumulation unit comprises:

an age calculation module configured to calculate an age of the one of the pixels based on previous compensation data thereof and based on a first weight that is a part of the weight; and a deterioration accumulation module configured to accumulate a deterioration amount of the one of the pixels based on a second weight that is another part of the weight and based on the age of the one of the pixels.

17. The display device of claim 16, wherein the weight calculation unit is configured to calculate a first weight and a second weight of a pixel group comprising some of the pixels based on an amount of current flowing through the pixel group and based on the number of light emitting elements in the pixel group.

18. The display device of claim 17, wherein the age calculation module is configured to calculate an age of the pixel group based on the first weight of the pixel group and based on previous compensation data of the pixel group, and wherein the deterioration accumulation module is configured to accumulate a deterioration amount of the pixel group by applying the second weight of the pixel group to the age of the pixel group.

19. The display device of claim 16, wherein the weight calculation unit is configured to calculate a first weight and a second weight of a pixel block comprising pixel groups having some of the pixels based on an amount of current flowing through the pixel group and based on the number of light emitting elements in the pixel group.

20. The display device of claim 19, wherein the age calculation module is configured to calculate an age of the pixel block based on the first weight of the pixel block and based on previous compensation data of the pixel block, and wherein the deterioration accumulation module is configured to accumulate a deterioration amount of the pixel block by applying the second weight of the pixel block to the age of the pixel block.

* * * * *